US007488919B2

(12) United States Patent
Gagas et al.

(10) Patent No.: US 7,488,919 B2
(45) **Date of Patent: *Feb. 10, 2009**

(54) WARMING APPARATUS

(75) Inventors: John M. Gagas, Milwaukee, WI (US); Scott A. Jonovic, Cottage Grove, WI (US); Daniel E. Stair, II, Cedarburg, WI (US); Richard C. Hochschild, Jr., Grafton, WI (US)

(73) Assignee: Western Industries, Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/216,443

(22) Filed: Aug. 31, 2005

(65) Prior Publication Data

US 2006/0043087 A1 Mar. 2, 2006

Related U.S. Application Data

(60) Provisional application No. 60/622,185, filed on Oct. 26, 2004, provisional application No. 60/606,396, filed on Sep. 1, 2004.

(51) Int. Cl.
*H05B 1/02* (2006.01)
*A21B 1/40* (2006.01)

(52) U.S. Cl. ..... 219/400; 219/411; 219/494; 219/518; 219/685; 219/711; 99/325; 99/331

(58) Field of Classification Search ..... None
See application file for complete search history.

(56) References Cited

U.S. PATENT DOCUMENTS 2,897,812 A * 8/1959 Albrecht ..... 126/19 R
3,958,552 A * 5/1976 Lawler ..... 126/247
3,978,238 A 8/1976 Frey et al.
4,039,776 A 8/1977 Roderick (Continued)

FOREIGN PATENT DOCUMENTS

JP 11-316022 * 11/1999

OTHER PUBLICATIONS

Wolf, Warming Drawer Use & Care Information, bearing a date indication of Jan. 2004; 16 pgs.

(Continued)

*Primary Examiner*—Joseph M Pelham
(74) *Attorney, Agent, or Firm*—Boyle Fredrickson, S.C.

(57) ABSTRACT

An electronically controlled warmer drawer includes an enclosure having sides and a top and a bottom defining a chamber. A movable holder is coupled to the enclosure for movement between a retracted position to support objects within the chamber and an extended position external to the chamber to permit access to the objects by a user. A heating system operates to heat the chamber and a ventilation system operates to move air through the chamber. A user interface with multiple inputs controls a temperature within the chamber. A detection system detects a condition within the chamber and provide a signal representative of the condition. A display device displays information for perception by a user, and an electronic control system interfaces with the heating system and the ventilation system and the user interface and the detection system and the display device so the objects can be maintained at a desired temperature.

50 Claims, 16 Drawing Sheets

U.S. PATENT DOCUMENTS 4,135,179 A * 1/1979 Snyder ..... 338/28
4,237,623 A * 12/1980 Timm et al. ..... 34/196
4,345,143 A 8/1982 Craig et al.
4,439,459 A 3/1984 Swartley
4,444,175 A 4/1984 Reynolds
4,446,780 A * 5/1984 Puvogel et al. ..... 99/480
4,468,424 A 8/1984 Cartwright
4,503,760 A 3/1985 Pryputsch et al.
4,622,231 A 11/1986 Swartley
4,751,368 A 6/1988 Daifotes
4,751,911 A 6/1988 Betts et al.
4,980,539 A 12/1990 Walton
5,086,752 A 2/1992 Hait
5,170,024 A * 12/1992 Hanatani et al. ..... 219/710
5,233,969 A 8/1993 Koledin
5,360,965 A * 11/1994 Ishii et al. ..... 219/705
5,365,039 A 11/1994 Chaudoir
5,417,148 A 5/1995 Cavallo
5,466,058 A 11/1995 Chan
5,619,613 A 4/1997 Otaki
5,676,051 A 10/1997 Sinemus
5,744,786 A * 4/1998 Kim ..... 219/711
5,783,803 A 7/1998 Robards, Jr.
5,873,300 A 2/1999 Kuhlman
5,900,173 A 5/1999 Robards, Jr.
5,948,301 A 9/1999 Liebermann
6,041,773 A 3/2000 Rosenquist
6,108,486 A 8/2000 Sawabe et al.
6,111,224 A 8/2000 Witt
6,116,154 A 9/2000 Vaseloff
6,121,583 A 9/2000 Hansen
6,124,572 A 9/2000 Spilger et al.
6,166,353 A 12/2000 Senneville et al.
6,191,391 B1 2/2001 Deo et al.
6,259,067 B1 7/2001 Faries, Jr. et al.
6,265,695 B1 7/2001 Liebermann
6,376,805 B2 4/2002 Faries, Jr. et al.
6,384,380 B1 5/2002 Faries, Jr. et al.
6,414,283 B1 7/2002 McNamara
6,444,955 B1 * 9/2002 Loveless ..... 219/400
6,484,512 B1 * 11/2002 Anderson et al. ..... 62/3.2
6,523,458 B1 2/2003 Turner
6,586,714 B2 * 7/2003 Kawamura et al. ..... 99/325
6,612,116 B2 9/2003 Fu et al.
6,660,974 B2 12/2003 Faries, Jr. et al.
6,693,260 B1 * 2/2004 Rodrigues ..... 219/385
6,849,835 B2 2/2005 Bollmers et al.
7,087,873 B2 * 8/2006 Hayakawa et al. ..... 219/682
2005/0178757 A1 * 8/2005 Starr et al. ..... 219/386

OTHER PUBLICATIONS

Wolf, Warming Drawer Installation Instructions, bearing a date indication of Nov. 2004; 12 pgs.
Gagas, John M., U.S. Appl. No. 11/147,511 titled Factory Preset Temperature Warming Appliance; filed on Jun. 8, 2005.
Gagas et al., U.S. Appl. No. 11/216,314 titled "Non-Food Warmer Appliance", filed Aug. 31, 2005 (Specification, Claims and Abstract 50 pgs., 11 pgs. of drawings, 61 total pgs.).

* cited by examiner

FIG. 10A
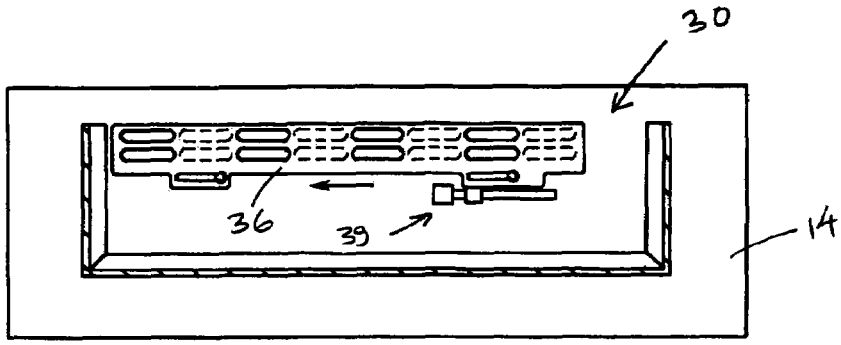
FIG. 10B
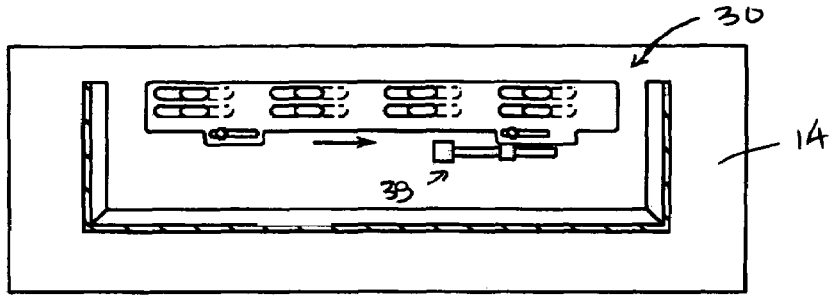
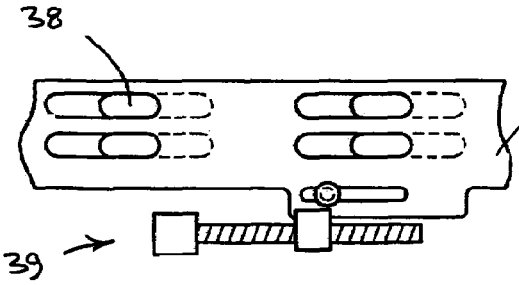
FIG. 11
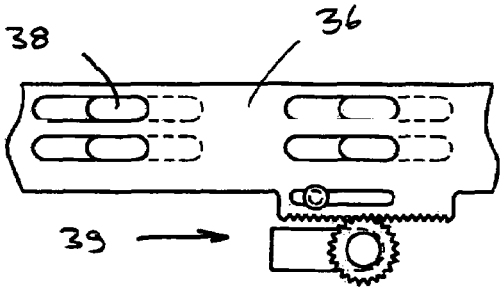
FIG. 12
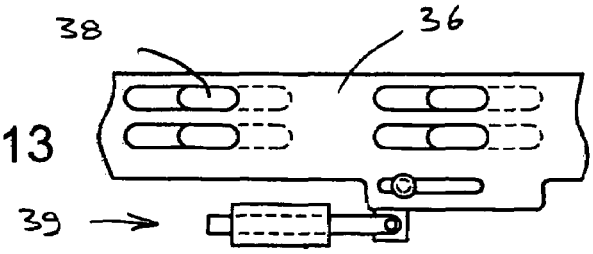
FIG. 13

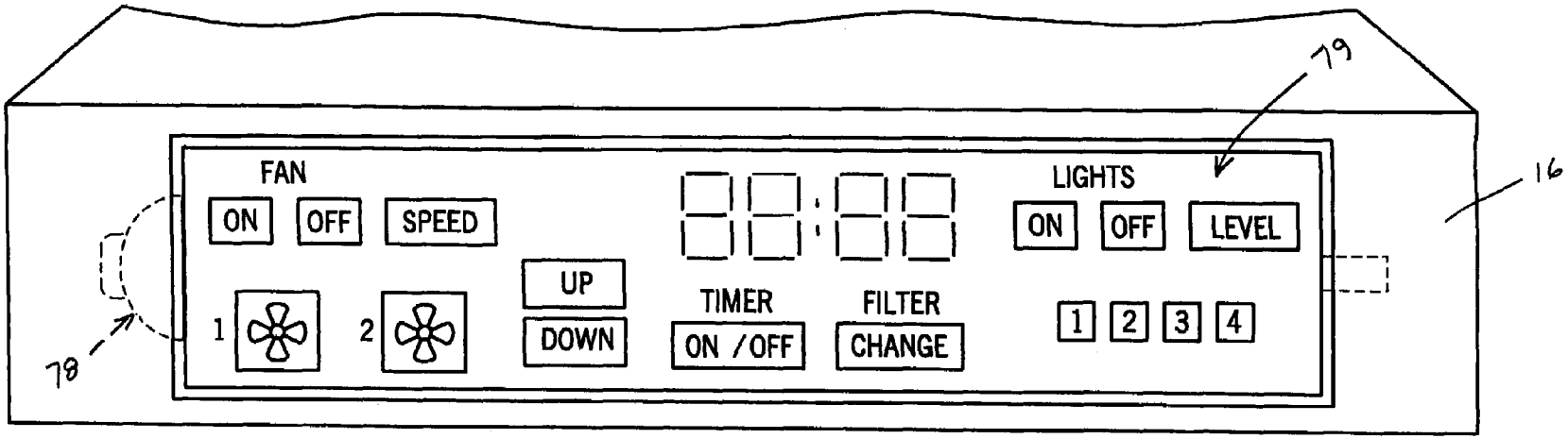
FIG. 35
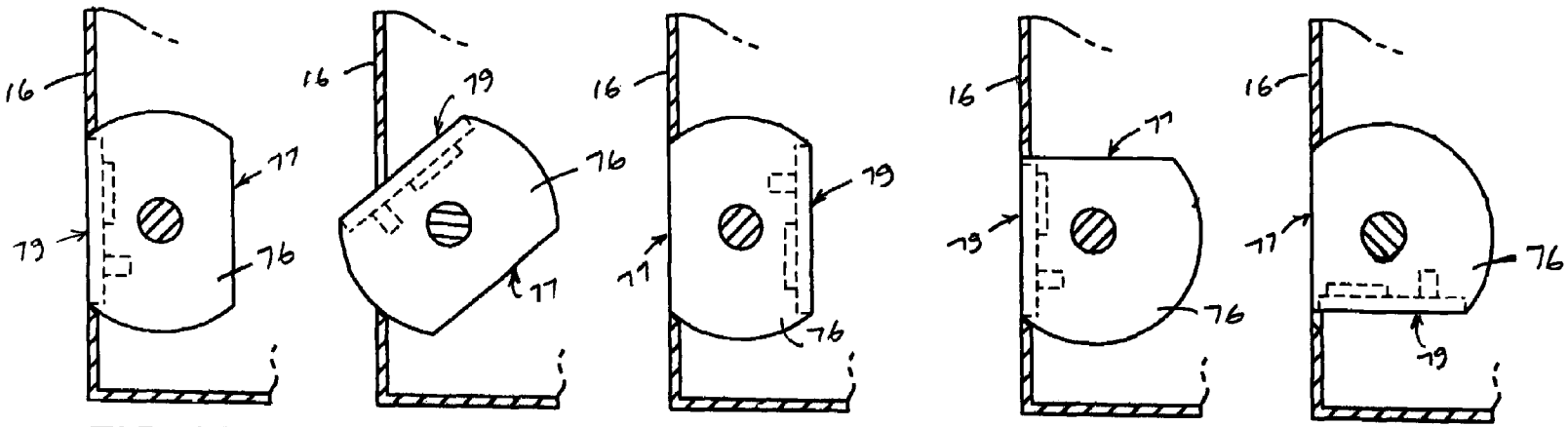
FIG. 36A
FIG. 36B
FIG. 36C
FIG. 36D
FIG. 36E

WARMING APPARATUS

CROSS REFERENCE TO RELATED APPLICATIONS

This Application claims the benefit of priority under 35 U.S.C. § 119(e) of U.S. Provisional Patent Application No. 60/606,396 titled "Warmer Drawer" filed on Sep. 1, 2004, and U.S. Provisional Patent Application No. 60/622,185 titled "Non-Food Warmer Drawer" filed on Oct. 26, 2004 which are incorporated herein by reference in their entirety.

FIELD

The present invention relates to a warming apparatus. The present invention relates more particularly to an electronically controlled warming apparatus, and more particularly to an electronically controlled warming drawer.

BACKGROUND

Warmer drawers of conventional design are typically configured as closed boxes, having a construction of single walled or a double walled with insulation or air in between and a sliding drawer of some sort to open up the interior of the box. Such conventional warmer drawers often have front door(s) fixed in a vertical plane and heating of the interior has been by a single cal rod (i.e. sheathed heating element) that will radiate heat, thus warming the interior of the box.

The conventional warmer drawers use mechanical controls to control and maintain the food temperatures. These mechanical controls tend to have an undesirable degree of inaccuracy and have a tendency to dry out food, overheat, have large swings in temperature ranges from a desired set point, which results in over and under shoots.

The sensors used in conventional warmer drawers to detect the temperature within the drawer have been mostly capillary tubes. Expanding gases, as temperature increases or decreases, transfers force or relaxes force to a mechanical switch, causing the switch to close or open, thus supplying current to or turning off current to the cal rod (i.e. sheathed heating element). The response time for these types of controls tends to be slow and also contributes to (or exacerbates) over and under shoots in temperature within the warmer drawer.

These sensors and the design of operation generally causes slow response for temperature corrections, thus causing temperatures to over shoot and under shoot. These resulting temperature ranges and swings, from the on to off cycling, have a tendency to drive moisture out of foods, hold more moisture in the chamber, and/or over cook food(s). Also, when set for the proofing temperature, bread will not proof correctly (i.e. not to rise properly) at lower temperatures, and at the higher temperatures bread tends to develop large pockets of air.

Conventional warmer drawer design typically locate the heating elements on the inside top or bottom of the chamber (e.g. box, cavity, compartment). A cal rod (sheathed heating element) used in varying patterns, provides radiant heat. This radiant heat often produces hot spots when placing an object like a pan or plate in close proximity to the cal rod. Temperature hot spots are understood to be due to the radiant heat source being strongest (hottest) near the cal rod and decreasing in temperature as distance increases away from the cal rod. Accordingly, such conventional warmer drawer designs provide undesirable temperature level variation within the chamber. These temperatures variations tend to cause problems for controlling and maintaining the food temperatures, such as stratifying or layering of air temperatures which causes problems for food holding. Also, start-up times to get warm temperatures in the chamber can be long due in part to the cal rod design. Such long start-up times are undesirable and prevent an operator from just turning the warmer drawer on and placing food in the chamber. Accordingly, such conventional warmer drawers have undesirably long start-up or pre-heat times necessary in order to stabilize the temperature inside the cavity at a desired level, otherwise food is held at lower temperatures, which can cool foods or encourage spoilage. Also as the temperature and heat cycles, large temperature over and under shoots tend to be created causing food to dry out, and loss of accurate temperature control for longer periods, and poor food holding capability.

Conventional warmer drawer designs typically use knobs and slides to set and control mechanical switches for setting the desired temperature. However, these mechanical switches are generally known to be inaccurate in their setting and repeatability. The mechanical switches often have problems maintaining a set point and can permit swings in temperature within the chamber partly due to the design of the warmer drawer and method of heating, but also due to the inaccuracy of the mechanical switches themselves. Mechanical control switches have a known condition of hysteresis, which contributes to their inaccuracy in the controllability to obtain a set temperature point or repeat a function. This inaccuracy can be demonstrated (for example) by turning the control to the right and stopping at a set point versus turning the same mechanical control past the set point and then turning the control to the left and stopping at the set point. Both actions end with the same set point selected but the resulting temperature will usually be different. The inaccuracy of the mechanical switches tends to increase the effects of having temperature over and under shoots and contributes to the large temperature swings inside the chamber of the warmer drawer. This inaccuracy is believed to contribute greatly to the gradiant temperature problems found in present warmer drawers with the chamber having problems with temperature over shoot and under shoot.

The mechanical switches typically used in conventional warmer drawers are also susceptible to the adverse effects of surrounding environmental influences. For example, if subjected to cold temperatures, mechanical switches could work slowly, crack, become hard to turn, fail to operate, their lubrication can harden causing the operation not to function, cause switch chatter resulting in premature failure or reduced life of product, and cause other detrimental issues to a user. By further way of example, if subjected to hot temperatures mechanical switches could experience slow operation from drying out of lubrication, crack, discolor, become hard to turn, fail to operate, experience switch chatter and/or premature failure, and cause other detrimental issues to a user when trying to set the controls or operate the warmer drawer. Further, if mechanical switches and/or controls are subject to outdoor environments like rain, snow, sun, UV, or the like, then special protected control switches are usually required to prevent intrusion of these environmental contaminants that may otherwise cause premature failure or reduced product life. Special sealed controls used in such environments tends to increase the price of a warmer drawer. Accordingly, mechanical switches and controls when used outdoors in conventional warmer drawers tend to create additional drawbacks such as needing to be covered or otherwise protected from the environment, which tends to increase the cost for such products.

Typical mechanical switches and controls for conventional warmer drawers tend to have poor repeatability and generally do not provide the user the ability to repeatably return to a certain preset position (e.g. reuse of same settings, etc.) or reliably establish the same temperature when using the conventional warmer drawer in a series of different operations. For example, a user generally cannot set a proper temperature on one day and then return the next day to the same set point if the controls were moved during an intervening period (as is often necessary). Temperature swings of as much as 30 degrees or more are believed to occur in such instances.

The conventional warmer drawers are also subject to other deficiencies. For example, conventional warmer drawers are typically constructed for use in permanent (e.g. built-in, etc.) installations, such as to cabinetry, an appliance, or some other generally stationary structure. Examples include conventional warmer drawers built into a cabinet under a product such as a cook top, oven, or some other appliance like a slide-in stove to a drop-in range. In other applications, conventional warmer drawers can be used in a location independently, but are still typically built into a cabinet or some structural frame. This limits the mobility of the warmer drawer from being used in a variety of desirable locations. Accordingly, it would be desirable to provide a warmer drawer capable of being used as a freestanding unit, as a mobile unit, used under a cabinet (e.g. suspended), or in areas with or without the support from a structural frame.

Therefore a need exists for a warmer drawer in which more accurate and controlled heating of objects such as food is accomplished. There also exists the need for an accurate method of controlling the operations and settings of the warmer drawer. There also exists a need for the controls of the warmer drawer to be less susceptible to environmental influences. There also exists a need for a display device to permit a user to be able to view/see the operation, temperature indication(s), set point functions, and view of the contents of the chamber. There also exists a need for a warmer drawer capable of remote control operation. There is a further need to accurately apply and control heat within the chamber of the warming drawer. There is also needed for a warmer drawer such that it can be used in any desirable location to suit the particular needs of a user.

Accordingly, it would be desirable to provide a warming apparatus, such as a warmer drawer having electronic control, with any one or more of these or other advantageous features.

SUMMARY

According to an embodiment, the present invention relates to a warmer drawer with an enclosure defining a chamber and having an opening. A movable portion is reciprocally movable within the chamber and a heating element provides heat to the chamber. A user interface receives an input from a user for controlling operation of the warmer drawer and at least one sensor provides a signal representative of a temperature in the chamber. An electronic control system interfaces with the heating element, and the user interface and the sensor and operates to control a supply of electrical power in a regulated manner to the heating element during operation of the warmer drawer, so that an object contained within the chamber is maintained at a pre-determined temperature.

According to another embodiment, the present invention also relates to a warming apparatus having an enclosure defining a chamber to receive objects and a heating device communicating with the chamber. A detection system with at least one sensor is provided to detect a temperature within the chamber. A user interface is provided for interaction with a user and operates to establish a desired temperature for the chamber. An electronic control system receives a signal from the sensor and the user interface to control the operation of the heating device to attain and maintain the desired temperature within the chamber.

According to a further embodiment, the present invention also relates to an electronically controlled warmer drawer that includes an enclosure having sides and a top and a bottom defining a chamber. A movable holder is coupled to the enclosure for movement between a retracted position to support objects within the chamber and an extended position external to the chamber to permit access to the objects by a user. A heating system operates to heat the chamber and a ventilation system operates to move air through the chamber. A user interface with multiple inputs controls a temperature within the chamber. A detection system detects a condition within the chamber and provide a signal representative of the condition. A display device displays information for perception by a user, and an electronic control system interfaces with the heating system and the ventilation system and the user interface and the detection system and the display device so the objects can be maintained at a desired temperature.

BRIEF DESCRIPTION OF THE DRAWINGS

FIGS. 10A-10B are elevation views of an exemplary embodiment of a warming appliance, including a venting system illustrating proportional venting to control heat and air flow in the warming appliance.

FIG. 11 is an illustration of a venting system for a warming appliance with an actuator to selectively operate the vent to control heat and air flow according to an exemplary embodiment.

FIG. 12 is an illustration of a venting system for a warming appliance with another actuator to selectively operate the vent to control heat and air flow according to another exemplary embodiment.

FIG. 13 is an illustration of a venting system for a warming appliance with a further actuator to selectively operate the vent to control heat and air flow according to a further exemplary embodiment.

FIGS. 35 and 36A-36E are a schematic views of a movable display device and use interface according to an exemplary embodiment.

DETAILED DESCRIPTION

Figure 2:
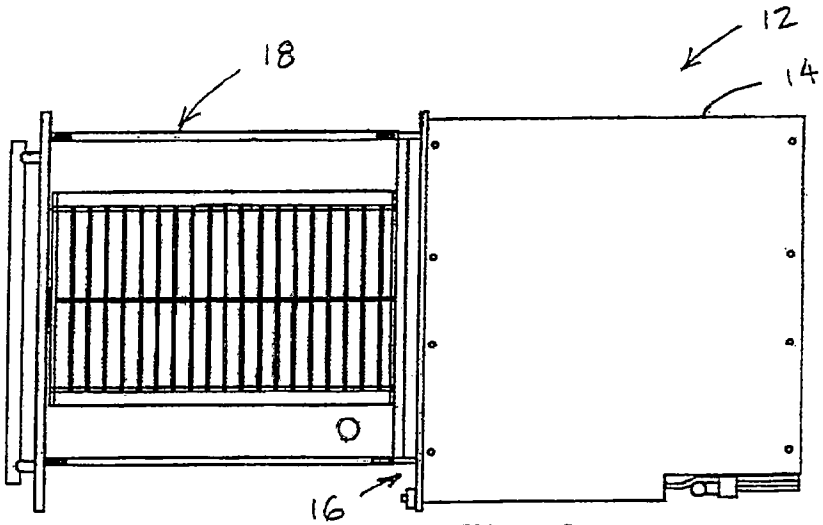
FIG. 2 is a top plan view of a warming appliance according to the embodiment of FIG. 1.
Figure 1:
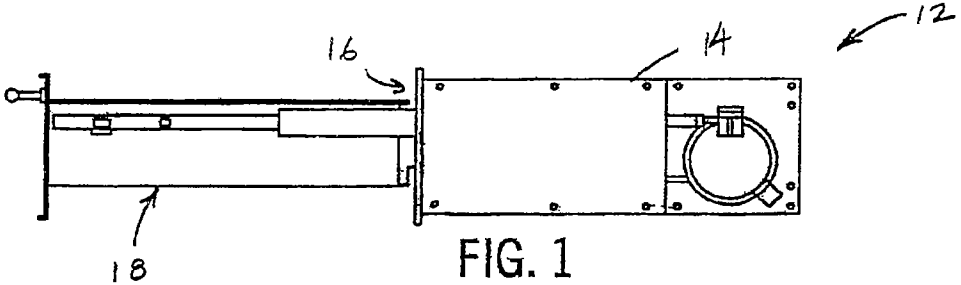
FIG. 1 is a side elevation view of an exemplary embodiment of a warming appliance including an electronic controller to control the temperature, humidity, power and other user defined parameters shown with a drawer extended from an enclosure.
Figure 3:
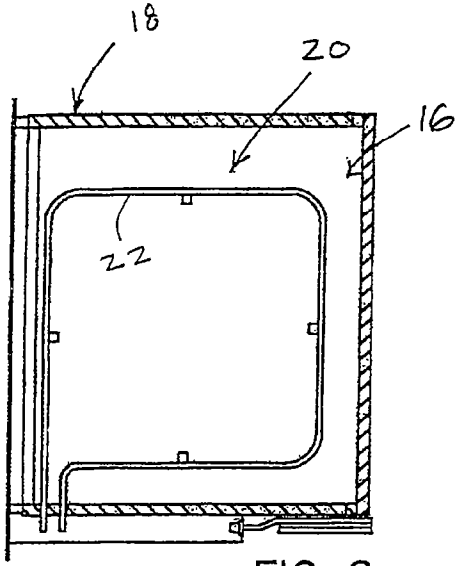
FIG. 3 is an illustration of an exemplary embodiment of a heating apparatus in a warming appliance.
Figure 4:
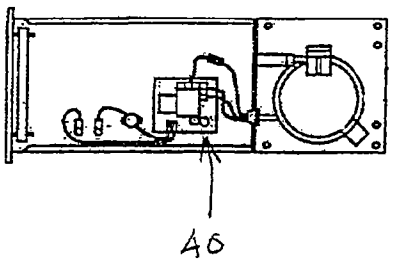
FIG. 4 is a side elevation view of a warming appliance with a drawer in a closed position and illustrating an exemplary embodiment of a user interface, power circuit, and an electronic control device.

According to the illustrated embodiments, there is disclosed a warming apparatus (shown and described as a warmer drawer 12) controlled by an electronic control system to provide improved chamber temperature control, rapid heat-up, improved temperature set point repeatability and minimal temperature variation from a desired set point. The electronic control system of the warmer drawer is shown to interface with (among others) a detection system having various sensors (e.g. temperature, humidity, infrared, scanners, electrical current, microwave, etc.), a heating element(s), a ventilation system, a display device and a user interface to enable a wide variety of desirable and advantageous features. For example, the warmer drawer is shown as a modular device that is adaptable for use in a wide variety of locations and environments and with other appliances, fixtures or structures. The warmer drawer (when in use) is intended to use a continuously adjustable amount of power in a heating element to maintain a more precise control of temperature within the chamber (rather than conventional and less-precise "on-off" type devices, however, the electronic control system could be configured for use with conventional heating elements and sensors to reduce swings in temperature). The warmer drawer is also shown to include a ventilation system that may be actuated by various technologies to regulate the flow of air, heat and/or moisture throughout the chamber. The ventilation system may include a heating element and/or fan within the chamber, or a heating element and/or fan may be located remotely from the warming drawer and fluidly interconnected by a suitable passage or duct. The warmer drawer is also shown to include a display device configured to display information to a user related to operation, temperature, functions, times or other control parameters for the warmer drawer. The display device is configured to display text (stationary or scrolling) and graphic images or illustrations. The warmer drawer is also shown to include a user interface (locally controlled and/or remote-controlled) to facilitate operation (e.g. selection of inputs, setting changes, start, stop, hold, etc.) of the warmer device by a user. The warmer drawer is further shown to have a temperature-controlled internal chamber that is accessible by access through a door or panel (e.g. "reach-in" etc.) or by a movable portion (e.g. movable holder, extendable portion tray, panel, drawer, etc. configured to hold objects within the temperature controlled environment of the chamber) that is extendable from, and retractable to, the chamber (in a manually-operated or power-operated manner). The warmer drawer is also capable of use in attaining and maintaining a desired temperature(s) for a wide variety of objects including foods (and other non-food items (e.g. plates, towels, etc.). The warming drawer as shown and described may also be constructed as a multi-use drawer (e.g. for warming, drying, baking, boiling, steaming, roasting, etc. and also for cooling). The ability to combine a warmer drawer with an appliance such as range, a mini-oven, a toaster oven, a steam drawer, a baking drawer, a boiling oven, a broiling oven, and a microwave oven thus reducing the space required and the ability to multi task from one appliance. This ability to combine a warmer drawer with an appliance or an appliance combined with a warmer drawer provides the user with advantages in space, reduce energy usage, and time savings. Accordingly, all such features are within the scope of this disclosure. However, this description is not intended to be limiting and any variations of the subject matter shown and described may be made by those of ordinary skill in the art and are intended to be within the scope of this disclosure.

Referring to the Figures, FIGS. 1-4 illustrate an exemplary embodiment of a warming apparatus shown as a warmer drawer 12 that includes a cabinet 14 (e.g. case, box, enclosure, etc.) having walls, a top, and a bottom that define a chamber 16 (e.g. cavity, compartment, etc.) within the inside of the cabinet 14. The cabinet also includes an external shroud (e.g.

the wrapper bottom/back) surrounding the walls, top and bottom to define the outer surface of the cabinet. Air or insulation is provided within the space between outer surface of the cabinet and the chamber wall inside the cabinet and is intended to provide improved heat loss control when using such a two-wall type construction. The use of only an inner chamber can be used as long as the surrounding surfaces are configured to withstand or accommodate the heat loss. The inner chamber is composed of a chamber bottom and sides, chamber top and sides make up the full inner chamber. A face plate (e.g. panel, door, etc.) provides the connection for the inner chamber and the outer surface of the cabinet to the front of the warmer drawer. Note here that there are many ways to construct a cabinet for a warmer drawer, which may include any number of layers from the inside chamber wall to the outside surface. This writing describes only two of the many ways for construction of a warmer drawer, but is intended to include all such constructions. According to other embodiments, the warmer drawer may consist of multiple warming cavities or compartments in the same appliance. Further, the chamber can be expanded and configured for quantity of items or containment of specific items. For example, the cabinet 14 can be expanded horizontally or vertically, also the warmer drawer may have various mounting locations in relation to another appliance (see FIG. 15 for example).

The warmer drawer 12 is also shown to include a heating system 20. The heating system is shown to include one or more heating elements 22 within the chamber 16 (shown for example as one heating element 22 within the chamber 16 in FIG. 3). The heating system 20 may also comprise one or more heating elements 24 in connection with the ventilation system 30 where the heating element(s) 24 are shown integrated with an airflow device (e.g. fan 32, etc.) located within the chamber 16 or external to the chamber 16 (see FIGS. 6, 7 and 27 for example). The heating element 22 is shown schematically in FIG. 3 as a cal rod (i.e. sheathed heating element) design that is used presently in many conventional warmer drawers. However, there are a number of alternative heating elements or technologies that can replace or supplement a standard, single cal rod type heating element. For example, such heating elements include (but are not limited to) convection heater(s); axial fan heaters, (having an integrated heating element and a fan); wire heating element(s); heat plate(s); thermal ceramic heater(s); flexible heater(s) which are also called thin film heating elements. The flexible heaters can be formed and bent into any shape. Other heating elements include: light(s); inductive heater; heat pump type which can provide heating and cooling (for applications involving a heating apparatus that can also provide cooling); warming liquids; sonic; heat exchanger, electromagnetic energy such as infrared heaters, radio frequency, gas, solid fuel products and microwave. These heating elements can be placed not only on the bottom of the chamber (as shown for example in FIG. 3) but also on the walls, on the top, front, and in the back of a warmer drawer or any combination of surfaces. Using these heating elements are intended to improve the heat control and accuracy of the temperature achieving even temperatures throughout the inside cavity. According to alternative embodiments, the use of two cal rods (or other suitable heating elements) can be used to improve upon the temperature(s) within a cavity and to further reduce pre-heat/start-up times. The use of electronic(s) and different heating elements can greatly improve on the start-up times reaching set temperatures faster. Likewise, pre-heat times, to stabilize the temperature inside the cavity, are reduced with the use of a heater or heaters listed above. Greater control means less over and under shoots resulting in better temperature holding capability. Greater versatility can be obtained with the use of electronic control and the different types of heating elements. According to other alternative embodiments, the heating elements may be configured to provide other thermal functions within the chamber (in addition to warming) such as baking, broiling, boiling, steaming, roasting, rotisserie, etc. and may include other suitable heating elements such as a microwave heating element, infrared heaters, etc. According to another alternative embodiment, a heating element may be made from a thermoceramic conductive coating having a geometric heat radiating pattern formed thereon to suit the particular geometry of the chamber.

The ability to better regulate the electrical current to the heating elements 22, 24 such that the power output can be increased or reduced with improved accuracy, and similarly increasing or decreasing the heat output to the chamber 16 with greater accuracy is achievable with electronic control. An electronic control system 40 for a warmer drawer 12 is shown, for example, in FIGS. 5, 8 and 9 and is intended for operation with AC or DC power supplies and is configured to regulate the amount of electrical power (e.g. current and/or voltage, etc.) to the heating elements 22, 24, and to control the speed of a variable speed fan 32, 34 and the position of a damper 36 (which may all be located at the warmer drawer or remotely from the warmer drawer) in the ventilation system, based upon input signals received from a detection system 50 variety of sensors located at suitable locations within (or external to) the chamber 16 (shown for example as a temperature sensor 52, a humidity sensor 54, an IR sensor 56, etc.). The electronic control system is also shown to interface with a display device 60 for presenting information to a user that is representative of the operation, temperature, time, function, performance or other suitable parameters of the warmer drawer or its constituent components. The electronic control system 40 is also shown to interact with a user interface 70 (which may be remotely controlled or locally controlled) that is intended to permit a user to directly input (or change existing inputs) such as time, temperature, etc). Accordingly, the electronic control system 40 is intended to enable a wide variety of new features/functions for the warmer drawer 12 and to provide an improvement over conventional products that cycle electrical current off and on (i.e. which have the elements provide full heat power "on" and then complete heat power "off" in attempt to reach and maintain a desired temperature. The electronically controlled warmer drawer 12 can determine the needed heat load for the chamber 16 (e.g. based on settings established by a user at the user interface 70 and/or input signals received from suitable sensors) and supply only that amount of heat, thereby minimizing over shoots with quick warm-ups and regulation of electricity and heat when approaching and attaining the desired set point.

According to an exemplary embodiment, the electronic control system 40 includes a positive temperature coefficient of resistance (PTC) current/voltage controller for controlling the heat and power requirements and providing rapid response during start-up. This PTC controller allows current to the heating element(s) 22, 24 and as temperature gets close to the upper limit, the PTC device limits the current to the heating element, stopping the rapid rate of heat/temperature increase in the chamber 16, thus preventing overshoot. PTC thermistors (thermally sensitive resistors) are solid state, electronic devices, which detect thermal environmental changes for use in temperature measurement, control and compensation circuitry and exhibit an increase in electrical resistance when subjected to an increase in body temperature. PTC devices remain in their low resistance state at all temperatures below the temperature corresponding to the desired set point. When the temperature corresponding to the desired set point is reached or exceeded, the PTC exhibits a rapid increase in resistance thereby quickly limiting current to the heating element circuitry to minimize temperature overshoot. Once the temperature within the chamber decreases to a normal operating level, the device resets to its low resistance state providing full load current to the heating element. The dramatic rise in resistance of a PTC Thermistor at the transition temperature tends to makes it an attractive candidate for current limiting applications. For currents below the limiting current, the power being generated in the unit is not sufficient to heat the PTC to its transition temperatures. However, when abnormally high fault currents flow, the resistance of the PTC increases at such a rapid rate that any increase in power dissipation results in a reduction in current. These devices have a resistance temperature characteristic that exhibits a very small negative temperature coefficient until the device reaches a critical temperature for the upper limit or set point of the warmer drawer, which is referred to as the "curie," switch, or transition temperature. As this critical temperature is approached, the PTC device begins to exhibit a rising positive temperature coefficient of resistance as well as a large increase in resistance. This resistance change can be as much as several orders of magnitude within a temperature span of a few degrees. Thus as the cavity chamber temperature increases from an ambient temperature, the PTC electronic device increases in surface temperature reducing the ability to dissipate heat which results in an increase in resistance resulting in reducing the current to the heating element. This increase in resistance and reducing current also slows down the heat up when coming to the set point. These devices also do not completely stop the flow of current to the heating element, but rather, limit the current. Thus providing and maintaining a steady temperature by substantially eliminating on/off swings that other conventional warmer drawers provide. This design also provides users with cost savings; since the undesirable "on/off cycling" with its corresponding overshoots and undershoots is avoided, the full current draw of the heating element is also avoided and the warming drawer uses only the required current for start-up heating and maintaining the desired temperature. According to other embodiments, the electronic control system includes any one or more of a micro controller(s), micro technology, integrated circuits, drivers and microprocessors that may be mounted on one or more printed circuit boards, to provide the desired functionality of interfacing with the heating elements, the ventilation system, the sensors, the display device and the user interface.

Figure 5:
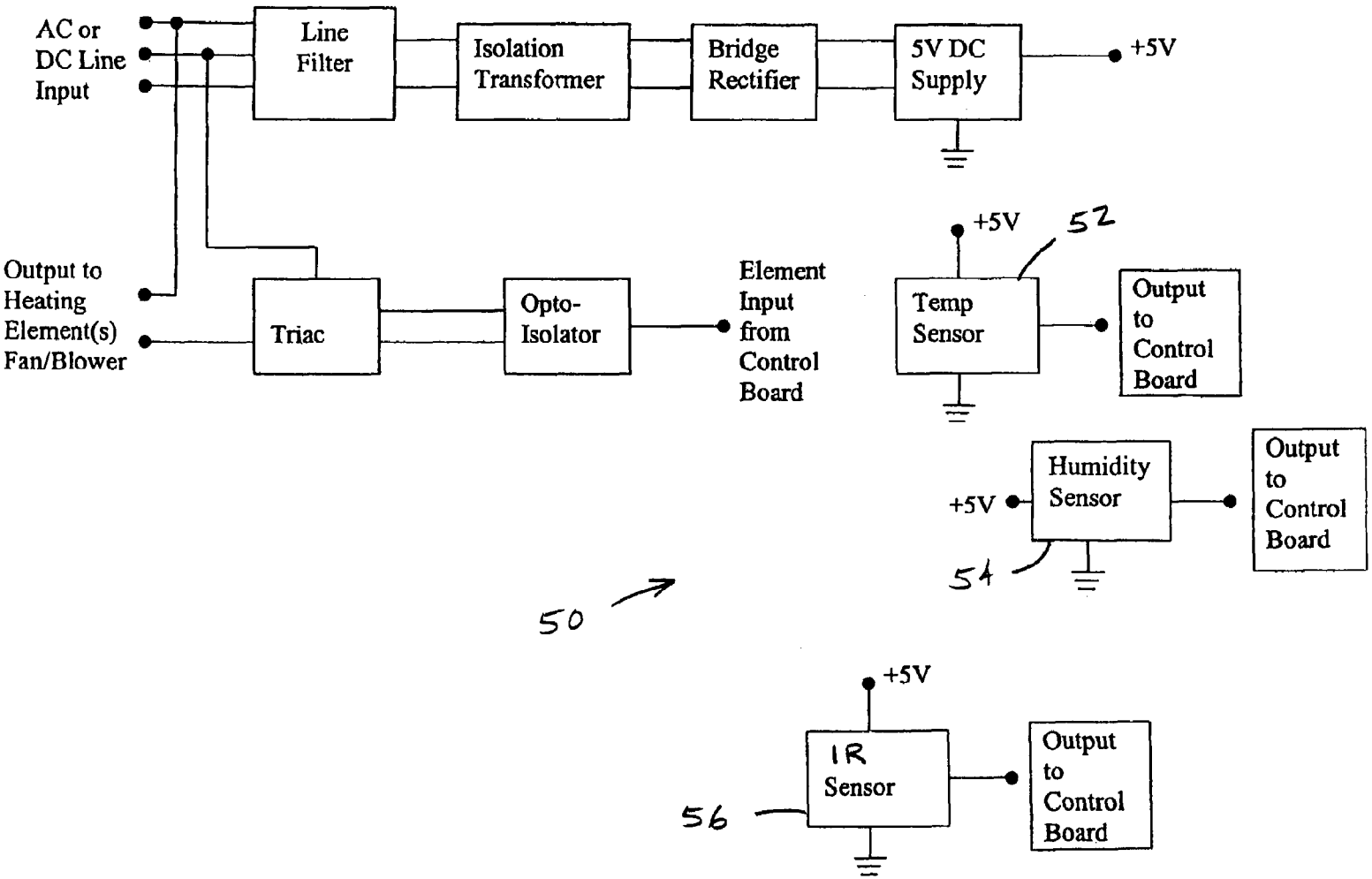
FIG. 5 is a block diagram of an exemplary embodiment of a power circuit for a warming appliance having an electronic controller and including a humidity control circuit and other sensors.
Figure 8:
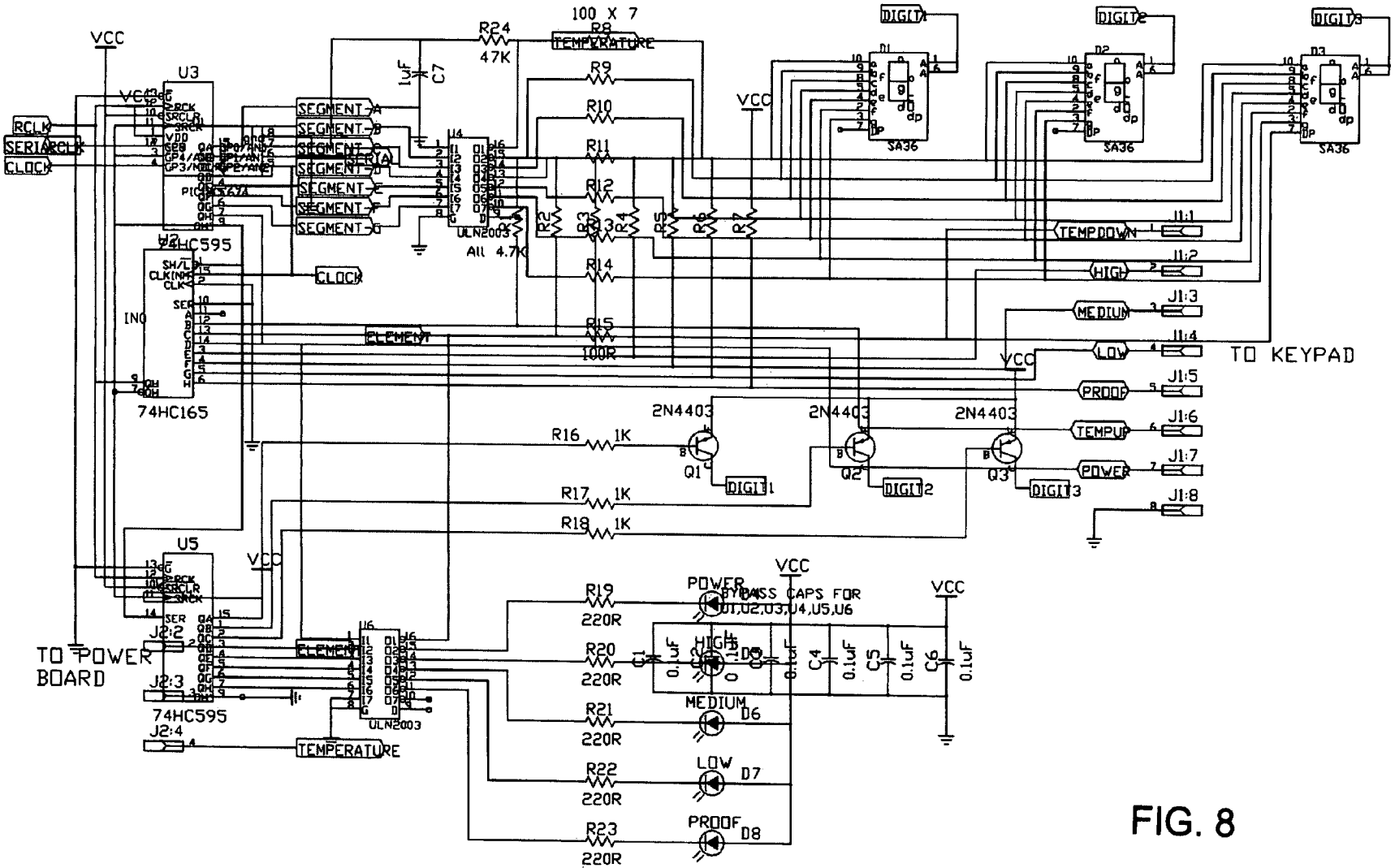
FIG. 8 is a schematic diagram of an exemplary embodiment of an electronic control circuit for a warming appliance.
Figure 9:
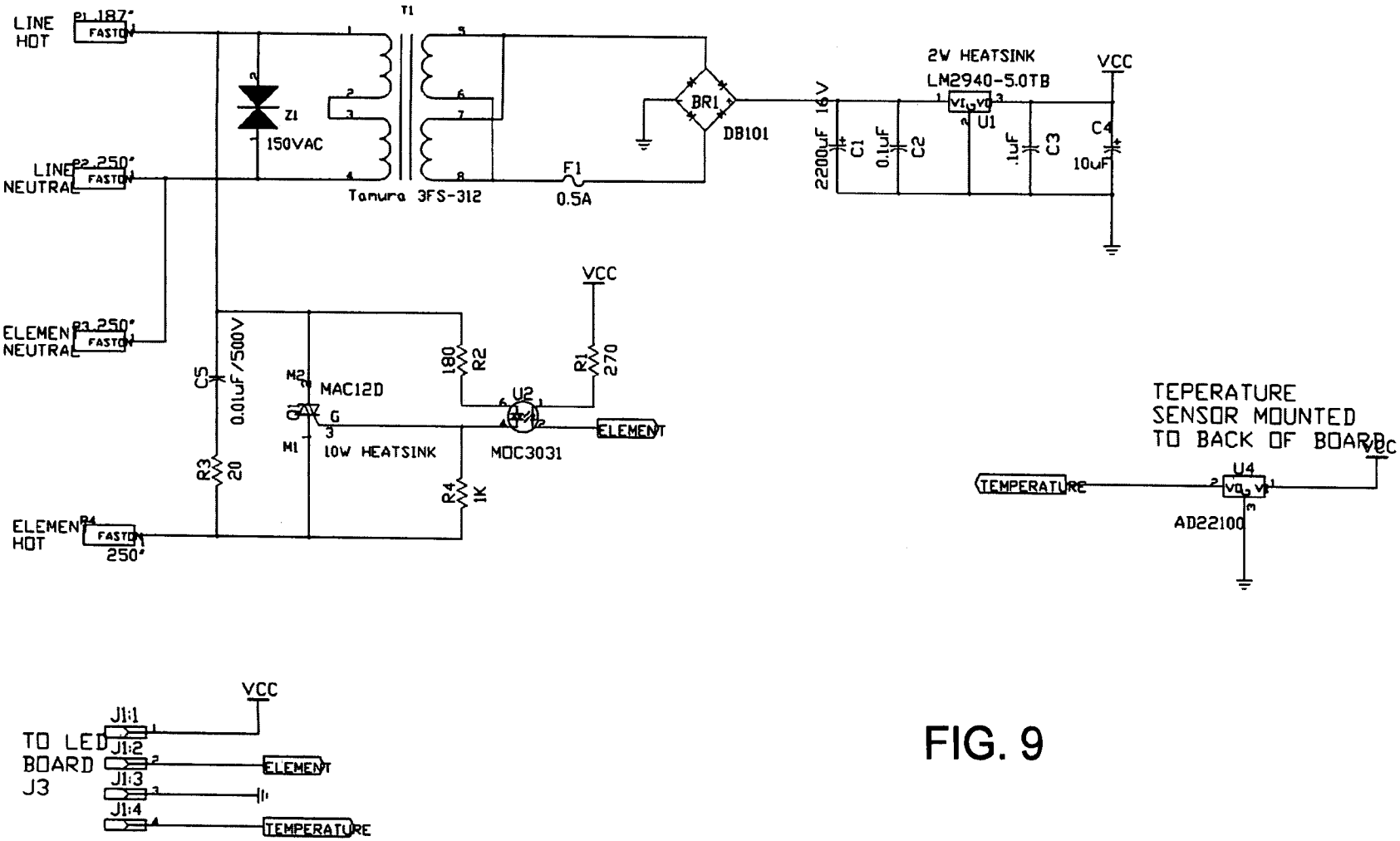
FIG. 9 is a schematic diagram of an exemplary embodiment of a power circuit for a warming appliance, including a temperature sensor and circuit.

The illustrated power board and control board show one type of electronic control (see FIGS. 5, 8 (control board) and 9 (power board)). The boards are shown as two boards, but may also be fabricated on the same board. Knobs to interface with the electronics can be provided, thus providing the "look" of a mechanical product. Construction of the electronics in a warmer drawer can use, but is not limited to, high heat construction design, specialized adhesive construction, use of loop resistant circuitry which is designed for use in membrane switches, special edge seal finishing for design of key pads using membrane switches, ESD/EMI/RFI shielding, electronics, and using display technology such as light emitting diodes, liquid crystal display, plasma, dot matrix, vacuum fluorescent display, etc. All of these can improve the control, display, design, look and operation of the electronic (s).

Such embodiment providing and electronic control system as described above is an improvement over prior art methods of cycling power on and off in an attempt to control the heat. With the improved method one can determine the needed heat load for the chamber and supply only that amount of power/heat. This also can prevent temperature over shoots by quick warm ups and when almost reaching the fixed set point, limit the amount of energy heat (current) when reaching the fixed set point. The ability to better regulate the electrical current to the heating elements such that the power output can be regulated will improve accuracy, and similarly increase or decrease the heat output to the chamber with greater accuracy. This innovation reduces the user's cost to operate this product. The electronics and sensors can determine the needed heat load for the chamber and supply only that amount of heat to the chamber.

Figure 22A:
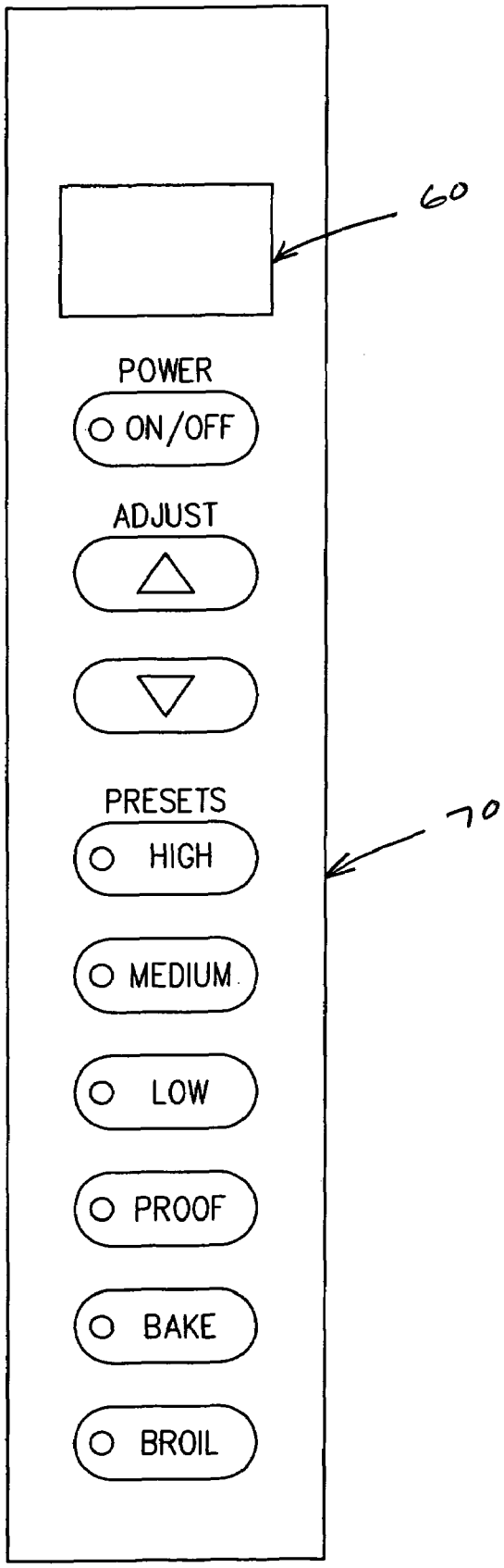
FIGS. 22A-22E are an illustration of exemplary embodiments of a user interface for a warming apparatus.
Figures 22B, 22C, 22D, 22E:
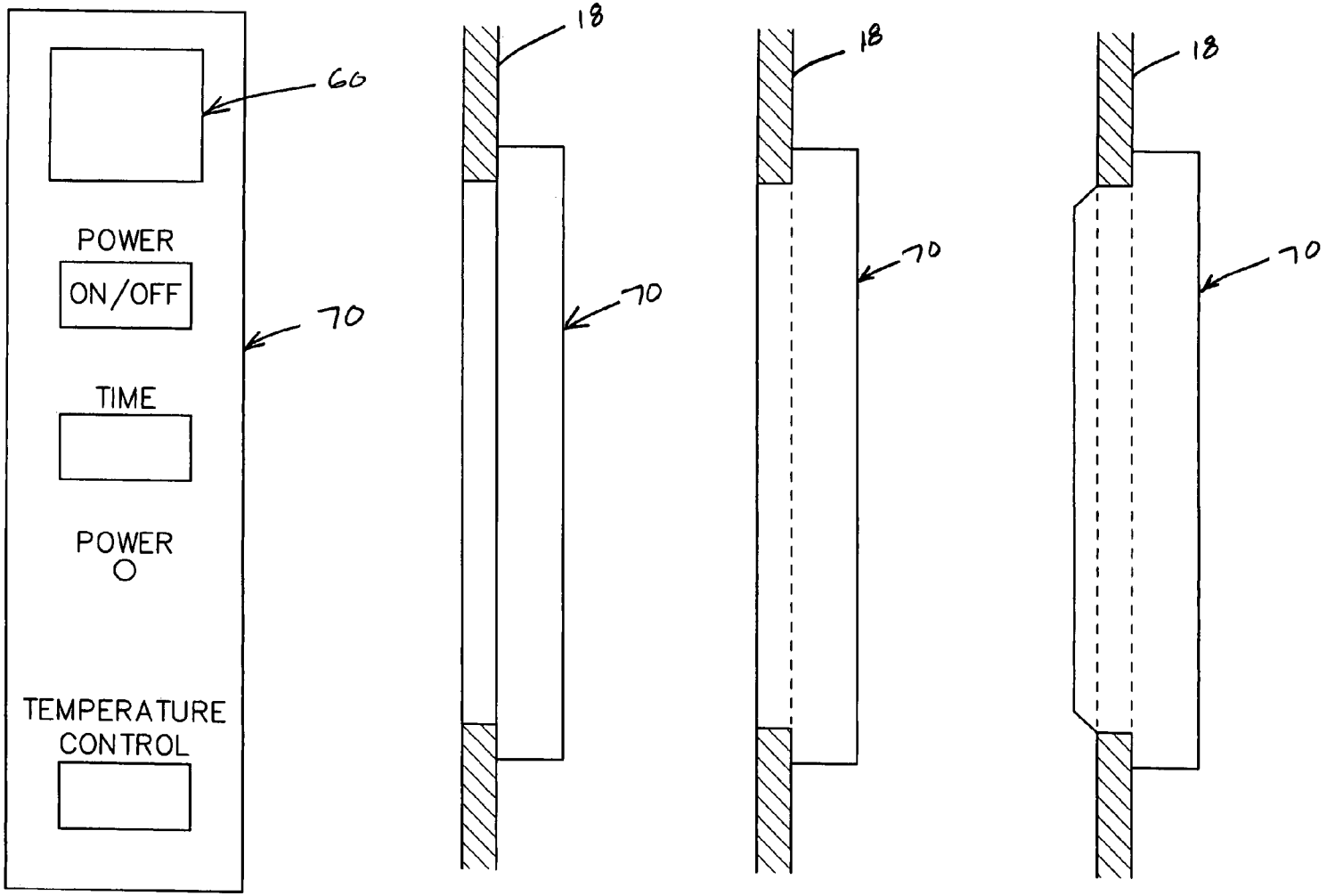

The warmer drawer 12 also includes a display device 60 (see FIG. 22A, shown for example as integrated with a user interface 70) that provides the ability to display to the user the operations, functions, temperatures, times and other features (e.g. fan speeds, alarm controls and signals, clock displays, message board-type displays, etc.) and may be provided in text (in any suitable language) or with suitable images (e.g. pictures, pictograms, graphics, animation, etc. such as a spinning fan, an image of a food product such as a fish, chicken, beef, etc.) using electronics to convey information to the user for accurately controlling operation of the warmer drawer 12 to advance the ability to cook and hold desired temperature (s). The display device 60 may include one or more display panels 62 (such as three or four LED display panels for providing numeric or text information (e.g. in a stationary or "scrolling" manner, etc.)). One or more of the display panels on the display device may also be configured LCD, plasma, dot matrix, vacuum fluorescent or other suitable type of display panels (in one or more colors and with varying degrees of illumination to adapt to background lighting) for conveying text, graphics or other desirable images to a user.

The warming drawer 12 also includes a user interface 70 (see FIGS. 22A-E, shown for example as integrated with a display device 60) shown as an electronic touch control panel 72 (e.g. touch pad, key pad, input device, etc.) according to an exemplary embodiment. The user interface 70 may include any suitable input elements 74 (shown by way of example in FIG. 22A as ON/OFF, ADJUST (increase and decrease) and PRESETS: HIGH, MEDIUM, LOW, PROOF, BAKE, BROIL; and by further way of example in FIG. 22B as POWER ON/OFF; TIME-SELECT; TEMPERATURE-SELECT), for selection and input of desired operations by a user, however any suitable input elements may be used to suit a particular application. According to any exemplary embodiment, the user interface 70 may be provided using any suitable technology such as (but not limited to) a piezo touch panel, or a capacitance electronic touch control panel (e.g. made of glass, metal or plastic, etc.) with selection of the operating function(s) made by touching the surface of the glass, metal, or plastic to operate any size warmer drawer/multi-use drawer could be used. In addition, tactile (membrane switches) touch control panel switch pad(s) for a 29.99" and smaller warmer drawer/multi-use drawer for touch controlling the operations of a warmer drawer could be used. Tactile (membrane switches) touch control panel switch(s) for 30.01" and larger warmer drawers for touch controlling the operations of a warmer drawer could be used. For any size warming drawer, other types of user interfaces may include resistance type touch control keypad (whereby touching plastic, metal, glass, etc.) at a location causes a change in an electrical signal to be measured and the electronic control system responds to this change). According to any exemplary embodiment, the user interface may include use of membrane switches, piezo, capacitance, paddles touch soft switch technology, paddles touch digital encoder (micro-encoder), capacitive, infrared, high frequency, magnetic, field effect, charge transfer, hall technology resistance and inductive. Further, the face panel of the user interface can be fitted with decorative rays, underlays, labels, trim and completed control panel assemblies. Touch control keypad(s) panels 72 can be installed flush. (see FIG. 22D), raised (see FIG. 22E), or recessed (see FIG. 22C) for use in connection with the electronic control system. Further, the touch control key pad(s) 72 of the user interface 70 can be installed in any plane of the warmer drawer 12 (or remote structure when operated by remote control) with the use of electronics. According to an alternative embodiment, the display device and the user interface may be arranged as separate (yet still intercommunicating) devices at any suitable location on the warmer drawer.

Electronic controls can be placed on any surface to accommodate any design or for matching or simulating the look of other products that may be associated with the warmer drawer. The touch control keypad(s) 72 of the user interface 70 and display(s) 62 of the display device 60 can be placed on the front of a warmer drawer 12 to provide the user with "instant viewing" of the operations and functions without having to open up the warmer drawer. Touch control panels 72 can be made of metal, plastic or glass to suit a particular application. The use of micro controller(s), integrated circuits and drivers, PC board(s), processor, and power, and other electronics can be used in the electronic control system 40 to interface with the touch pads 72 of the user interface 70 to control operation of the warmer drawer 12. Any size from a small to a large warmer drawer can be fitted for use with a touch type control pad (e.g. piezo, capacitance, resistance, etc.). Further, any size from a small to a large warmer drawer can be fitted for use with an induction touch control pad. The design of the electronics can be unique or matched to the other looks, aesthetics, appearance or decor on adjacent or cooperating appliances or structures. The overall size, design, look and feel of a warmer drawer can be matched to the size, design, look and feel of any appliance or structure.

Figure 23:
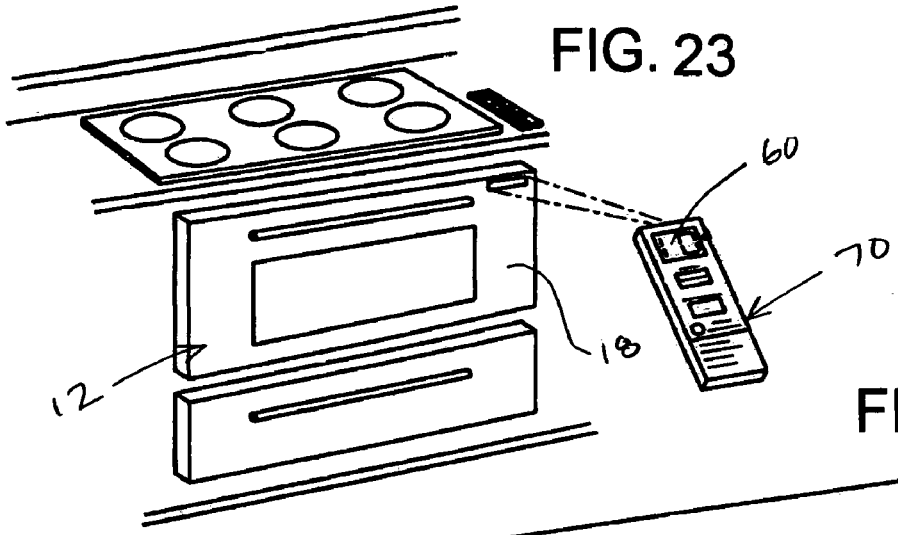
FIG. 23 is a perspective view of an exemplary embodiment of a multi-use warming apparatus associated with another appliance (shown for example as a cook top) and controllable remotely with a remote control unit.
Figure 24:
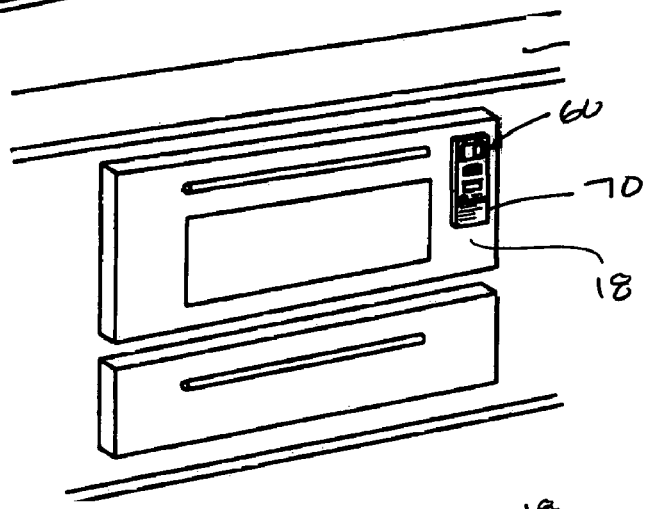
FIG. 24 is a perspective view of an exemplary embodiment of a multi-use warming apparatus having a removable remote control unit coupled to the face plate of the warming apparatus.
Figure 26:
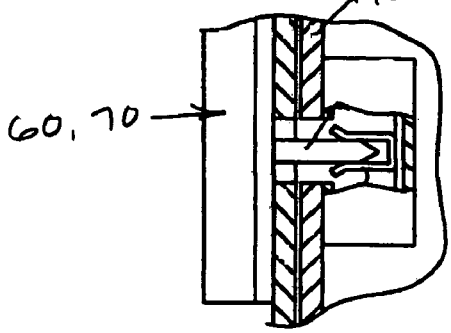
FIGS. 25 and 26 are detailed views of an exemplary embodiment of a coupling method of the user interface to the warming apparatus illustrated in FIG. 24.
Figure 25:
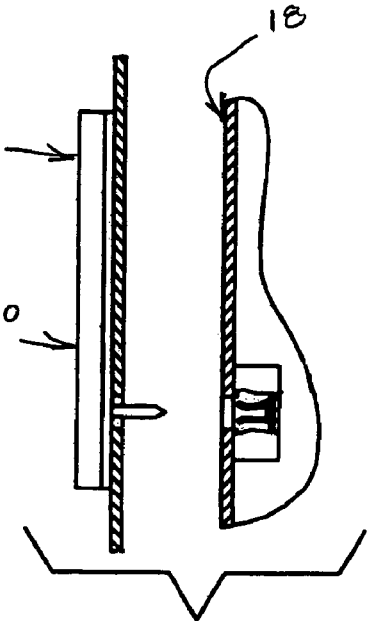

According to an exemplary embodiment, the touch control panels 72 of the user interface 70 can be remotely controlled having the electronics or a portion of the electronics located not on the product, but in a different location not on the warmer drawer (see FIG. 23). Remote control can be by wire or by wireless controlling the functions of a warmer drawer. The touch control panels 72 of the user interface 70 may have graphic(s) (e.g. pictographs that are unique or specific to the design for the matching product(s) or specific to the required designs and functions, etc.). The use of electronic provides the user with better control and offers more flexible operations than can be obtained with a conventional mechanical control system. With this flexibility the user can perceive (e.g., see, hear, etc.) what is happening and can modify the function of the warmer drawer to achieve a desired performance.

The structures for the display device 60 and the user interface 70 control functions could be mounted to the fixed faceplate or the movable face/door of a warmer drawer (see FIGS. 22C-22E and 24). With the display device 60 and/or user interface 70 mounted on the face panel with the warmer drawer closed, viewing of the display device and user interface can be an indicator of the operations inside the chamber 16. In applications where the electronics are mounted on the face panel of the warmer drawer 12, the electronics can be disconnected when the drawer is pulled out thereby disconnecting functions. Disconnection can be accomplished by wireless communication or by a wired system. Wires of suitable length can be provided so as not to disconnect operations and interfere with the operation of the drawer being opened.

According to another exemplary embodiment, the display device 60 and/or user interface 70 may be placed on any desired surface of the warmer drawer or associated structure (e.g. to accommodate any design for matching or simulating the look of other products the appliance may be paired with, or to protect the components from damage, or exposure to adverse environments, etc.). By way of example, the display device 60 and user interface 70 may integrated (shown for example as an integrated display/interface 79; however, the display and interface may be kept as separate devices) and arranged to be "hidden" from normal view by the closing of a sliding panel (which may be spring-biased) or by integrating the display/interface 79 with a rotating panel or L-shaped plate (shown for example as a rotating drum 76 in FIGS. 36A-36E) which may be mounted on a stationary portion 0.14 of the warmer drawer or on the extendable portion 18 (e.g. movable holder, etc.) and repositionable in a variety of orientations for ease of viewing/operation and for concealment. This ability to conceal the display/interface, to protect it from damage, or match other looks, and having it independent of the moving drawer but still have a flush looking front from two parts, or to provide a smooth looking front is intended to enhance the functionality and options available to a user for operation of the warmer drawer. Once the user has completed viewing the display or operating the interface, the user (or the warmer drawer itself) can rotate the drum to a position to conceal the display/interface and expose a "matching" panel 77 to provide a smooth-looking or substantially uniform front appearance. According to one embodiment, electronic sensors may be provided in the display/interface so that the user can touch the front of the display/interface for movement to a storage position or for movement to a viewing/operating position. When the electronic sensors in the display/interface sense the "touch", the rotation begins until reaching the stop point (e.g. at the next "position" of the display/interface), such as the display/interface panel provides the smooth front. Another way the display/interface may be moved to the storage position is if the warmer drawer (or another associated appliance) have been "off" for a predetermined time period. Once such a predetermined time period has elapsed, the display/interface may automatically move from the viewing/operating position to the storage position. A drive device such as a motor or actuator (shown for example as a drive motor 78 in connection with the display/interface 79 in FIG. 35; however, other suitable devices for rotating the display assembly can be used to provide movement) is provided for operation of the repositionable display/interface. Suitable devices such as switches, stepper motor(s), magnetism, or a positive stop like metal can be used for the location of "stop points" for locating the desired positions of the display/interface.

Figure 6:
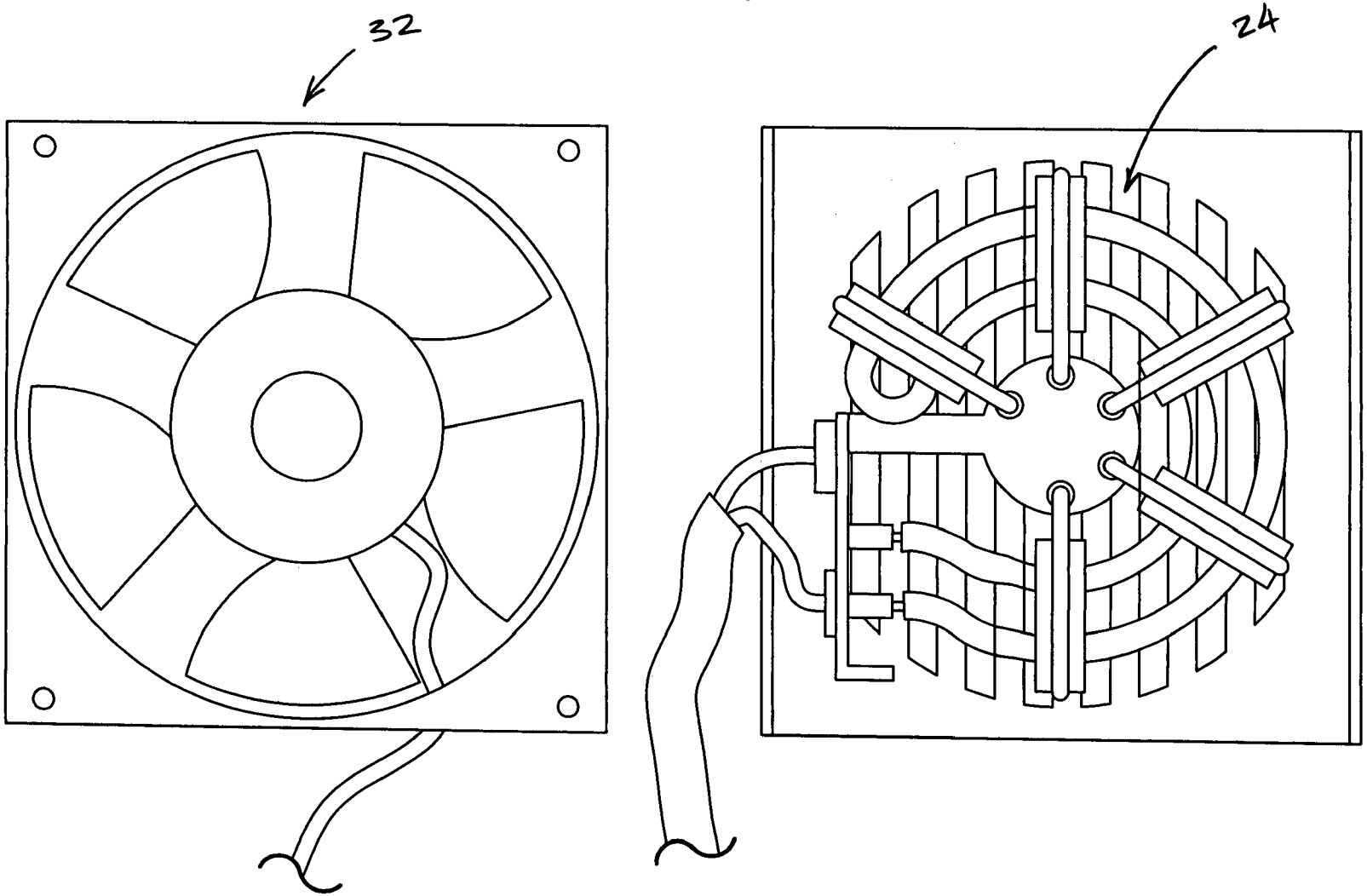
FIG. 6 is an exemplary embodiment of a fan/heater apparatus for use with a warming apparatus.
Figure 7:
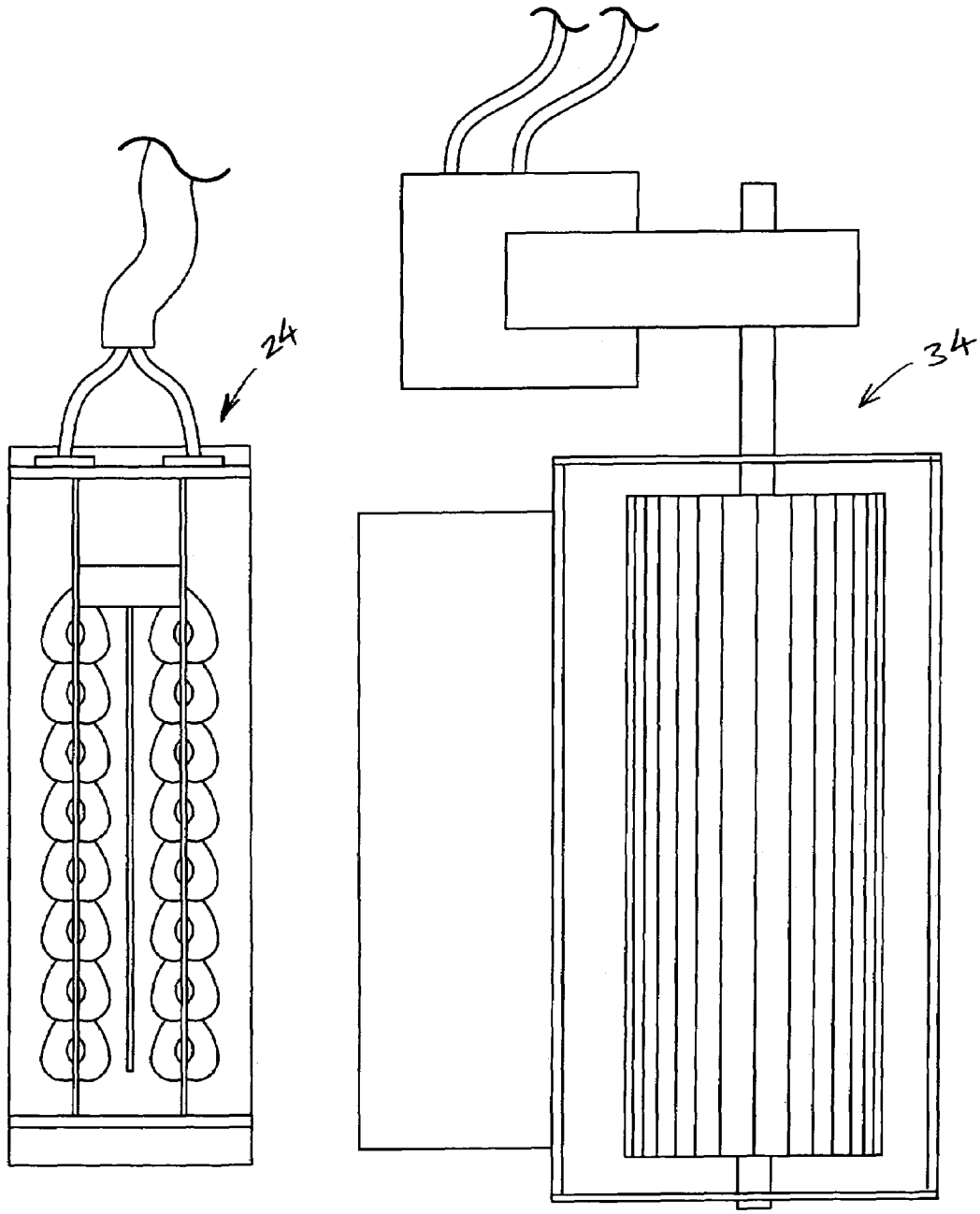
FIG. 7 is an alternative exemplary embodiment of a fan/heater apparatus for use with a warming apparatus.

According to another embodiment shown for example in FIGS. 6 and 7, the warmer drawer includes a fan 32, 34 (with or without a heating element 24 attached to the fan, and shown as an axial fan 32 with heating element 24 in FIG. 6 and a cross blower 34 with heating element 24 in FIG. 7) that is secured to the inside of the chamber or located remote but in fluid communication with the chamber (e.g. by a duct 37 etc. see FIG. 27 for example) to circulate the heated air and that interfaces with the electronic control system 40 to receive its control and electrical power. The illustrated fan configurations are intended to provide improved heat control and response time by improving the uniformity of the temperature within the chamber 16 and minimizing layering, stratification or other gradients (i.e. not necessarily for convention cooking purposes). With the slowly circulating air, "hot spots" are substantially eliminated within the chamber 16. Also, slow moving air generally will not adversely affect the hold quality of the object(s) in the chamber 16, but will improve upon it because the temperature over and under shoots are substantially eliminated. Accordingly, chamber temperature management is also improved by ventilation control to substantially eliminate temperature gradients, large temperature swings and reducing pre-heat/start-up time within the chamber. A fan or other device for moving air (or otherwise providing air movement within the chamber) is also intended to provide humidity control within the chamber 16. Humidity build-up in the chamber 16 can be controlled by providing a vent system with controlled variable size openings, such as a powered vent system (see FIGS. 10A-13). Having a variable speed fan/motor associated with a vent with variable size openings for moving air in and out, and mounted inside the chamber 16 or mounted outside the chamber 16 is intended to provide different air flows as needed to control (e.g. increase, decrease, maintain, etc.) moisture accumulation and/or temperature differences with the ability of introducing fresh air in the chamber 16. A fan moving the air can provide "mixing" and substantially prevent front to back, side to side, or top to bottom temperature differences. The resulting air movement by a fixed or a variable speed fan is intended to hold a uniform temperature throughout the chamber. The fan 32, 34 can also be used for ducting heated air or moisture out of the chamber 16 of the drawer 12. Another aspect of this design is the ability for the fan 32, 34 to be controlled by a humidity sensor 54 in cooperation with the electronic control system (see FIG. 5). This can improve on the quality of the food or non-food items being held in the chamber 16.

According to the embodiment illustrated in FIGS. 10A-10B, the vent with variable openings includes a damper 36 or louver(s) configured to coact with apertures 38 (e.g. holes, slotted openings, etc.) to provide ambient air inlet(s) or exhaust passageways, that can be variably postioned between "opened" (as shown in FIG. 10A) and "closed" or at a partially opened position therebetween either manually or by an actuator 39. According to a preferred embodiment, the vent system 30 includes a sliding damper 36 that interacts with the apertures 38 and is driven by an actuator 39 that receives a suitable signal from the electronic control system 40. For example, the actuator 39 may be configured as a motor-driven drive screw (see FIG. 11), or a motor driven slide/rack and pinion device (see FIG. 12), or a solenoid operated device (see FIG. 13), or bimetallic device, or an electromagnetic device, or other suitable electronically or electro-mechanically controlled device for adjusting the position of the damper 36 in relation to the apertures 38. The ability to control the flow of air and moisture within the chamber 16 by an actuator 39 coupled to a damper-vent apparatus is intended to regulate the flow of air being exhausted from, or brought in to, the chamber 16 of the warmer drawer 12. This controls the loss of moisture (humidity) or the ability to hold moisture inside the chamber. The air inlet(s) or outlet(s) can be opened immediately all the way (full open) or closed all the way (sealed chamber) or opened to a preselected position to control heat or moisture build-up. The size of the air inlets/outlets through the vent apertures 38 may also be modulated based upon a suitable signal from the electronic control system 40 (such as in response to a signal representative of a humidity level or signal from the humidity sensor 54). With the use of a forced air (powered) or circulating air system, even greater control can be had with a power venting system. The damper (e.g. louver, slide, etc.) allows for flows to be proportional thus controlling air movement and heat. Vent apertures 38 can be located at any suitable place such as in the front or face panel of the warmer drawer 12, at the side top and/or at the bottom, or any other suitable location to achieve a desired air flow pattern within the chamber 16. The warmer drawer 12 can be configured with any venting configuration which will permit air to leave or enter the chamber 16. Any suitable and connected actuator 39, for example, a motor, that can provide motion, which can be transformed into movement for closing or opening the vents can be utilized. A humidity sensor 54, including associated electronics, can detect and provide control to the vent fan 32, 34, and heater 22, 24. Such device can also be configured to provide user input (e.g. through the user interface) for setting the desired humidity level inside the chamber.

According to another embodiment the warmer drawer 12 may be configured as a multi-use—warmer drawer that combines a mini-oven, warmer drawer/broiling cavity, multi-use warmer drawer/steam oven, multi-use warmer drawer/baking oven and multi-use warmer drawer/microwave oven in any suitable combination. Combining the warmer drawer with other heating or cooking products can reduce space used in a kitchen (institutional, commercial, residential, etc.). Using these warmer drawer/multi-use drawers can save electricity and heat energy due to their small size. A large portion of the energy consumed in cooking applications is often associated with preparation of small amounts of food. Having to heat up a large oven takes time and is more expensive than using a mini-oven/warmer drawer. This mini-oven/warmer drawer could take the place of a toaster oven saving counter space. When combined with a broiling element within the chamber 16, additional capabilities for cooking and providing temperature holding capabilities may be realized that are not presently found in conventional products. Another embodiment provides a "multiple use" warmer drawer/mini-oven/broiling cavity. It is readily apparent from the above description that combining the warmer drawer 12 as described herein with other cooking equipment can be a great benefit to a home kitchen or other food preparation or maintenance location. It also readily apparent from the disclosure that any desirable appliance with a warmer drawer.

Figure 14:
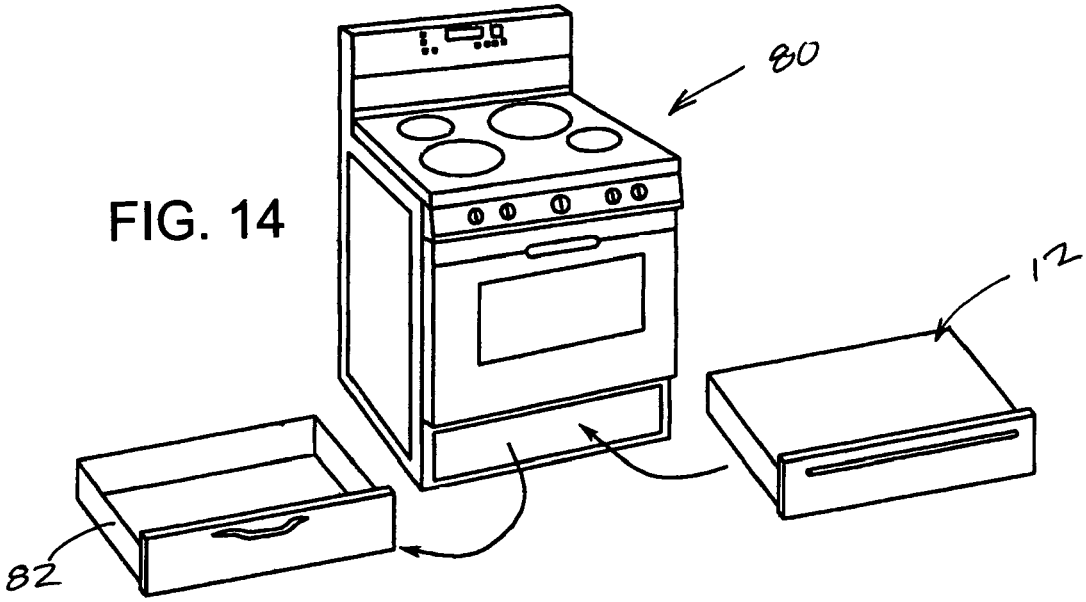
FIG. 14 is a perspective illustration of an appliance configured to exchange a storage drawer (shown as the left device) for an exemplary embodiment of a warming apparatus (shown as the right device).
Figure 15:
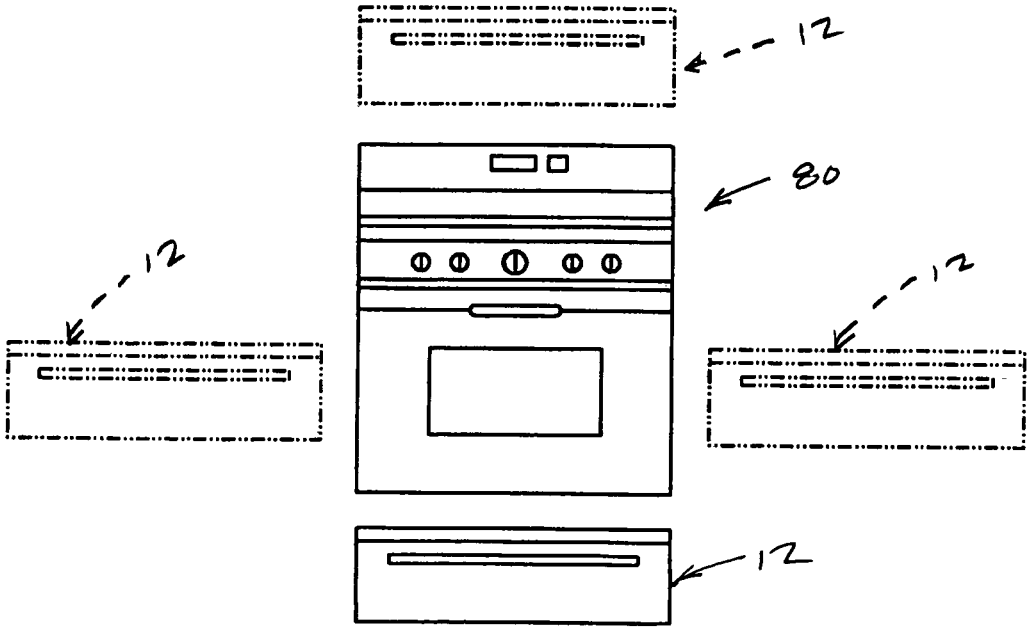
FIG. 15 is an illustration of possible locations of a warming apparatus in relation to another appliance (shown for example as a stove).

According to another embodiment, a warmer drawer 12 or multi-use drawer can be configured as a modular unit having the ability to be adapted to "fit" into a range or other appliance (s) without being built-in (see FIGS. 14 and 15 for example). A modular warmer drawer 12 or multi-use drawer can be operated independently from the other appliance with which it is associated. For example, the lower storage drawer 82 of an oven/freestanding range 80 can be removed and replaced with a modular unit 12 in its place to provide cooking space and food holding capability. This warmer drawer 12 or multi-use drawer would operate independently of the freestanding range 80.

Figure 16:
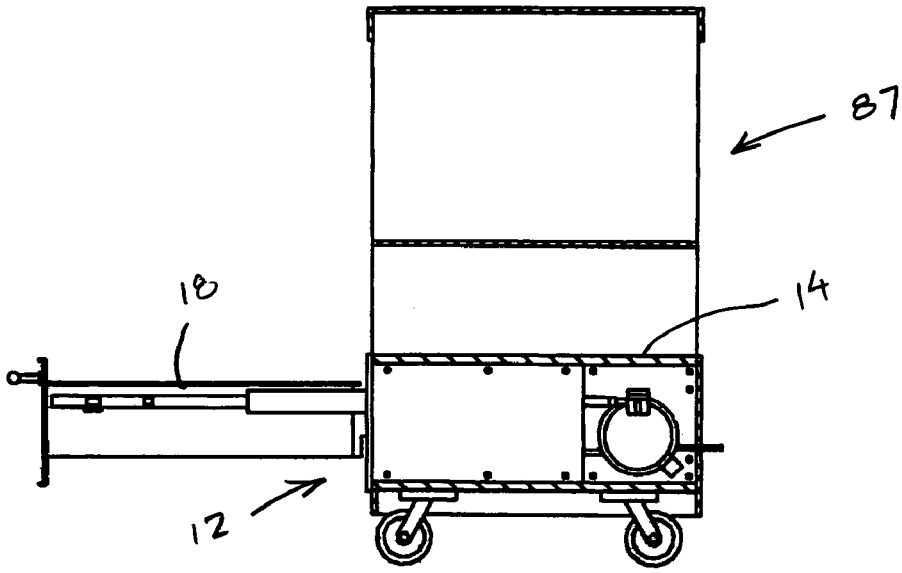
FIG. 16 is a side sectional view of an exemplary embodiment of a free standing warming apparatus mounted on wheels for mobility.
Figure 17:
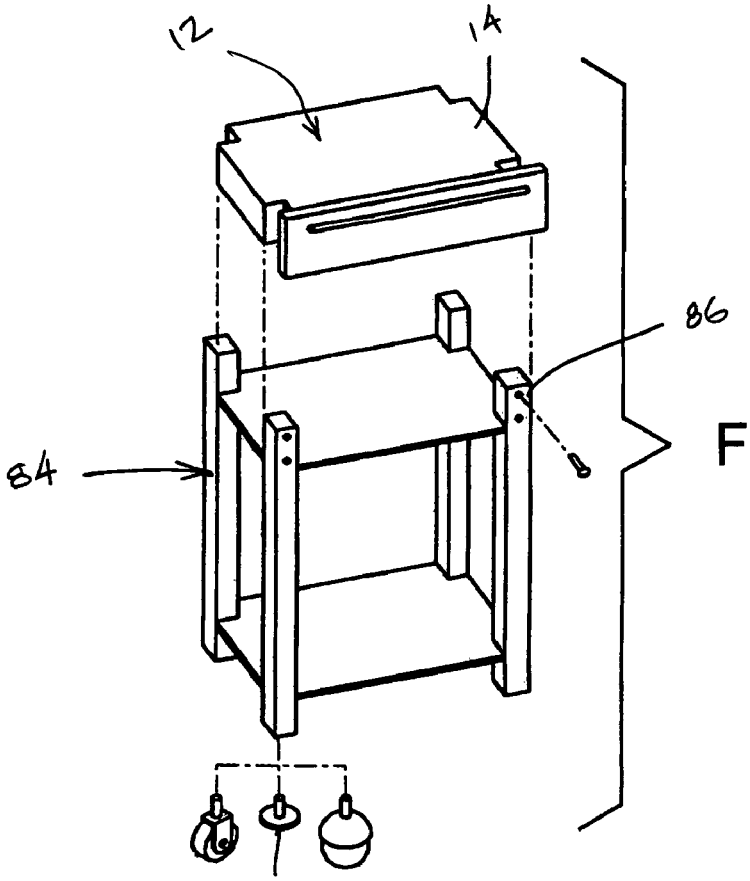
FIG. 17 is a perspective view of an exemplary multi-use warming apparatus configured to couple to a stand structure which can be movable, as facilitated by several alternative devices.
Figure 18:
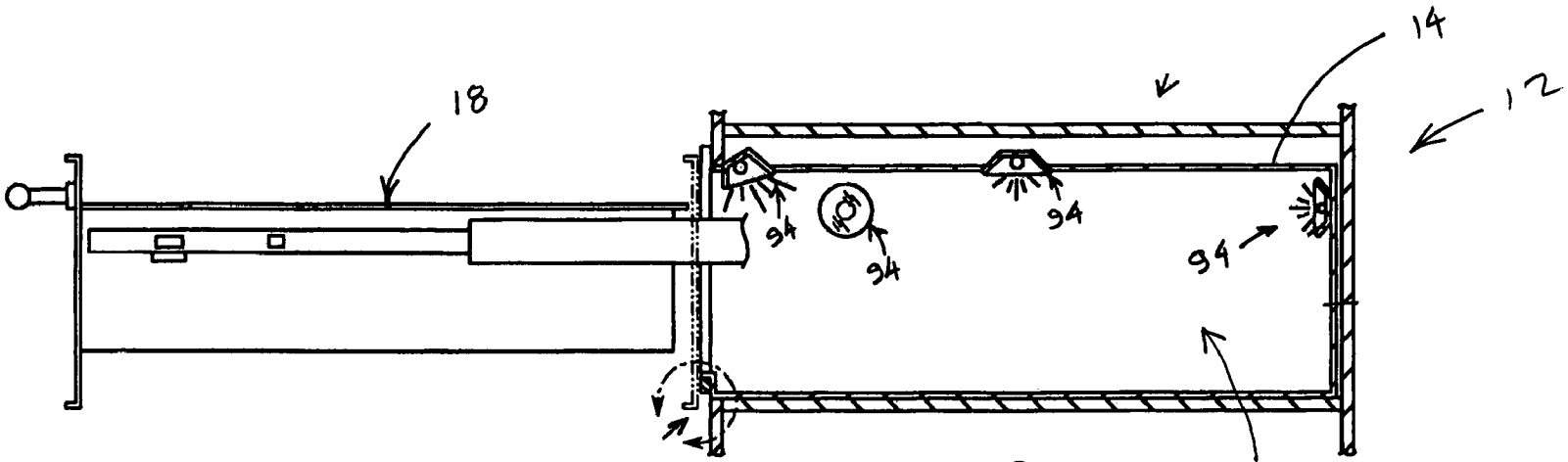
FIG. 18 is a sectional view of an exemplary embodiment of a warming appliance illustrating several locations of light fixtures mounted in the chamber.

According to another embodiment the warmer drawer 12 is adaptable as a warmer drawer/multi-use drawer shown for example as a mobile pedestal heated chamber with drawers, slides, or doors for warming, cooking and holding food and non-food applications (see FIGS. 16-17). The warmer drawer/multi-use drawer is shown for example as combined with a mobile pedestal 84 to provide a heated chamber apparatus that is shown as not built into a wall, cabinetry, structural member, immovable island or other non-mobile structure. A warmer drawer/multi-use drawer having a heated chamber, accessible by doors, drawers, lids, or the like is configured to rest on the floor or on other surfaces and be freestanding on its own. The warmer drawer/multi-use drawer or its pedestal 84 is intended to be self-supporting and rests upon its own structure (shown for example as footpads, foot pegs, legs, wheels or casters, etc.). A structure attachment can be made directly to the warmer drawer/multi-use drawer or to a mobile frame 86, upon which the warmer drawer/multi-use drawer is supported. The structure attachment can be removed when not in use or it can be permanently attached. The warmer drawer/multi-use drawer can be removed and placed on any desired surface for use and then returned to the structure attachment, or the warmer drawer/multi-use drawer may remain coupled to its pedestal 84 and immobilized during use (e.g. by wheel locks, chocks, etc.). The mobile frame can be made of wood, metal, plastic, composite material or any combination of such materials intended to provide a lightweight yet sturdy support and transport structure. Another embodiment of the warmer drawer/multi-use drawer can provide for use indoors or outdoors, such as by weather-resistant features (e.g. sealed touch pads, electronic modules, gasketed door panels, etc.).

A mobile heated warmer drawer/multi-use drawer can also be installed into a mobile island or cart 87 to be used for cooking and holding food (and for non-food applications as well) (see FIG. 16 for example). Such a mobile warmer drawer, island or cart can be equipped with a cutting/work surface top made from metal, wood, solid surface materials, or other materials. The top can be a fixed cutting/work surface or made removable for remote working/cleaning/serving or replacement. According to any exemplary embodiment, the warmer drawer/multi-use drawer as shown and described (e.g. mobile or stationary, etc.) may be used in any desirable location for any suitable application. For example, the warmer drawer/multi-use drawer may be used in kitchens (institutional, commercial or residential) for food items and non-food items, and may also be used in eating or serving areas or devices (e.g. caterers, buffets, picnics, lunch-carts or trailers, etc.) or may be used in other applications such as hotels, resorts, spas, golf courses, cruise ships where it is desirable to maintain the temperature of objects (such as food objects and non-food objects) for the comfort or convenience of users, customers, consumers, guests, staff, etc.

According to another embodiment, a warmer drawer/multi-use drawer 12 is provided that is configured to be controlled by the electronic control system 40 and equipped with an AC or DC electronic temperature sensor 52 located inside the chamber 16 such that the temperature of the chamber 16 can be detected accurately. Controlled by electronics and equipped with an AC or DC electronic temperature sensor 52 provides control and operation response, to sense temperatures in the chamber 16 and then the electronic control system 40 provides a suitable output to control the heating element(s) 22, 24 functions for on/off or regulated power operation. Any electronic sensor used for detecting temperature, resistance, or power using such devices as thermos/thermal detection device(s) for the control of the chamber temperature can be used with the electronic system in a warmer drawer/multi-use drawer. The heating element is electronically connected to a temperature-sensing device and is AC or DC powered in accordance with requirements for the warmer drawer installation or use location. With user selected settings (e.g. through the user interface 70) or preset (factory or otherwise) settings of the electronic control system 40, the signals associated with maintaining the desired temperature(s) within the chamber 16 are sensed and sent by the temperature-sensing device 52 within a predetermined desired range of operating temperature(s) or set point(s). The sensor 52 can be mounted on the electronic board or it can be attached by itself to any wall or location in which detection of the temperature can be made. The ability to better detect the temperature within the chamber improves the response time to the changes inside the chamber and improves the accuracy of the actual temperature in the chamber when compared to the desired set point. This quick response and control reduces the effects of overshoot and undershoot. Any electronic, mechanical, or electromechanical sensor can be used for detecting temperature, resistance, or power for detection and control of the temperature in the chamber with the use of electronics. Any electronic, mechanical, or electromechanical, AC or DC sensor can be used for detecting and control of temperature, resistance, or power for better control of the chamber temperature. Such sensing or detecting devices, which can be used include, but are not limited to temperature sensors, thermostats, thermal, temperature controls, thermal protectors, thermal cutoffs, thermal switch, thermocouples, adjustable thermostats, printed circuit board thermostats, hermetically sealed, time delay relay, bulb and capillary, cold controls, electronic controls, bimetallic, pressure switches, creep action thermostats, resistance temperature detectors, controllers, manual reset, automatic reset, disc thermostat, snap action switch, negative temperature coefficient of resistance thermistors, power positive temperature coefficient of resistance thermistors that can be controlled by electronics, or other suitable device. The sensing devices, along with the electronic control system is intended to provide better temperature control of objects within the chamber and ultimately, improved user satisfaction.

According to another embodiment, sensing technology such as scanner detection technology may be used to directly sense the temperature of an object in the chamber for providing a signal to the electronic control system for controlling the power and heat from the heating element and/or controlling operation of the ventilation system 30. A warmer drawer 12 can have the ability to detect objects placed inside the chamber 16 and then set temperature(s) for maintaining required temperature. For example, in a warmer drawer with item detection on a target surface, an IR sensor 56 collects a small amount of energy (usually 0.0001 watt) radiated from the target, generates an electrical signal that is amplified by a precision amplifier and converted into voltage output. A CPU digitizes the signal by an Analog-to-Digital Converter, an Arithmetic Unit solves a temperature equation based on Planck's Radiation Law, compensates for the ambient temperature and emissivity resulting in a temperature reading within a fraction of a second after user places the item in the field. Using this technology one can measure the temperature of an item or cover the complete surface from a five (5) meter distance as long as the Field of View is filled by the target. Also, many IR sensors measure in the 8 um to 15 um wavelength band where the atmosphere is almost totally transparent. IR sensors can operate in complete darkness. In the 8 um to 15 um wavelength band, IR can penetrate PE film (for example: a plastic trash bag or saran wrap). The IR thermometer sensor 56 can detect the presence of the object.

IR sensing can measure objects that move, rotate, or vibrate (e.g., web process or any moving process). They are understood not to damage or contaminate the surface of the object of interest. They measure the temperature of the actual product being used in a warmer drawer and not some of the other parts of the surfaces. Thermal conductivity of the object being measured such as glass, metal, wood or even very thin objects does not present a problem, as is the case with certain other sensors. Response time is typically in the millisecond range, which gives the user more information per time period. The IR detector system can be used for heat/fire and/or distance in the warmer drawer. The use of thermal sensing technology such as RTDs (resistance temperature detectors), integrated circuit sensors (IC), thermistors, IR thermometers, bimetallic, and thermocouples can also be used. Other sensors like photoelectric, photon, optics, indium-gallium-arsenide, and thermal detector could be used in place of IR for the detection of items placed on the surface.

Another embodiment provides a warmer drawer/multi-use drawer configured for outdoor locations having the ability to weather typical outdoor temperatures and environments. The use of electronics for warmer drawer/multi-use drawer can provide better sealing for use in these environments. With the use of remote locations for the electronic controls when the drawer 12 is used outdoors, the effects of the environment on the controls is minimized. Electronics are typically not subject to mechanical problems of "turning force" due to cold temperatures in certain locations. They are usually resistant to environmental conditions and problems to an extent unlike mechanical controls and switches, which can develop rusting or dust build-up for example. The electronic controls are also usually not subject to cleaning problems, as are mechanical controls. Electronic controls can be best suited for outdoor applications where extreme temperatures and weather conditions exist, because they typically have no (or minimal) mechanical moving parts to fail.

Figures 27, 28, 29, 30:
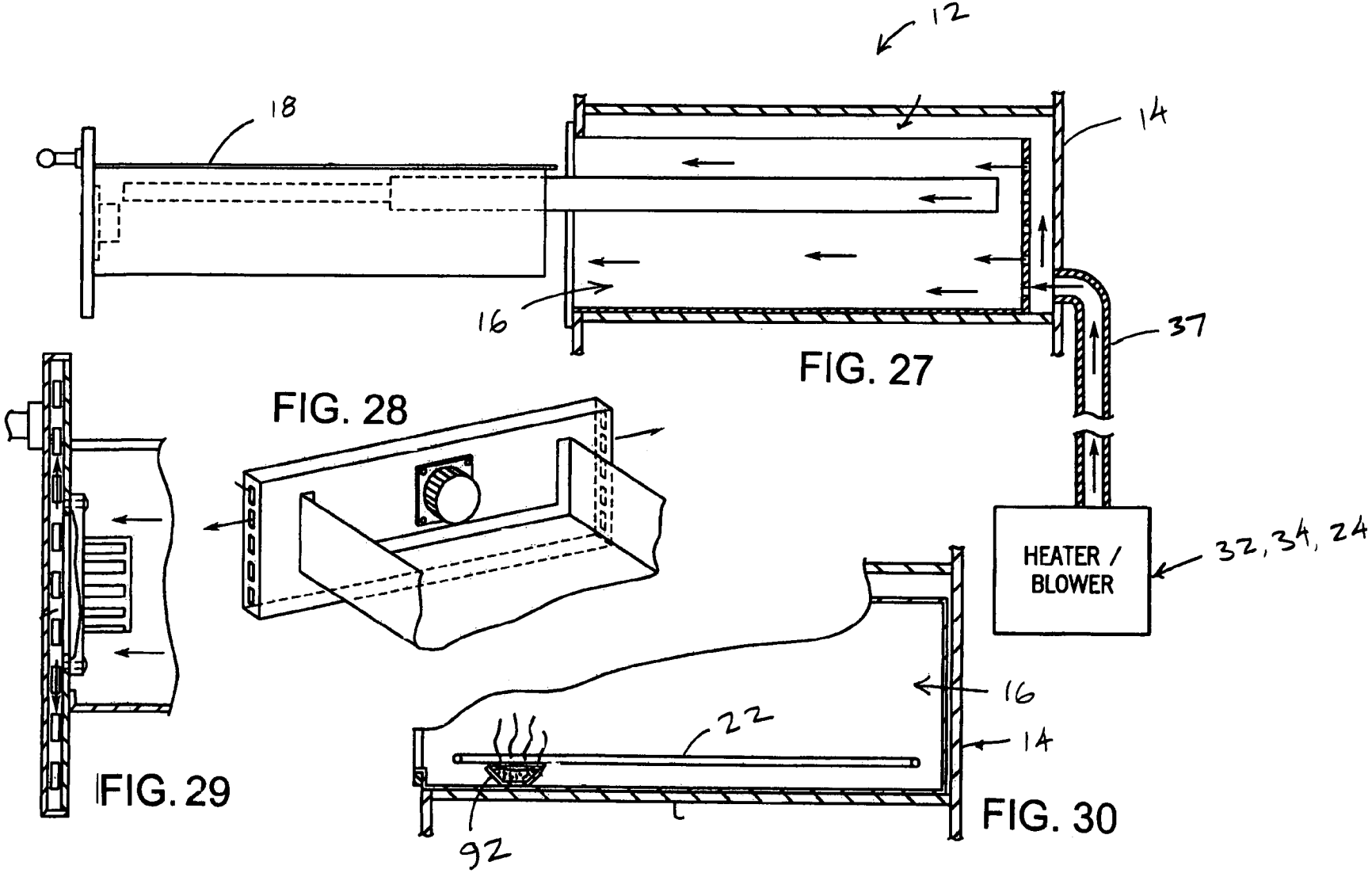
FIG. 27 is a sectional side view of an exemplary embodiment of a warming apparatus coupled to a remote heater/blower.
FIG. 28 is a partial perspective view of an exemplary embodiment of a warming apparatus illustrating alternative venting from the chamber (arrows depict an exemplary air flow pattern).
FIG. 29 is a side view of the venting illustrated in FIG. 28.
FIG. 30 is a partial side sectional view of an exemplary embodiment of a warming apparatus including a depository for a fragrant substance in gaseous communication with the drawer of the appliance.

Another embodiment provides for the use of aromatic materials 90 such as favoring additives, e.g. wood clips, liquid smoke, etc.) or fragrances that can be added into a receptacle 92 within the chamber 16 to impart flavoring to food objects or desirable fragrances to non-food objects inside the chamber of the warmer drawer (see FIG. 30 for example). This can be accomplished by a receptacle 92 such as a special pan in contact with the heating element 22 or by evaporation, or flavor adding can be accomplished by venting or ducting from a different chamber or outside the chamber.

Figure 21:
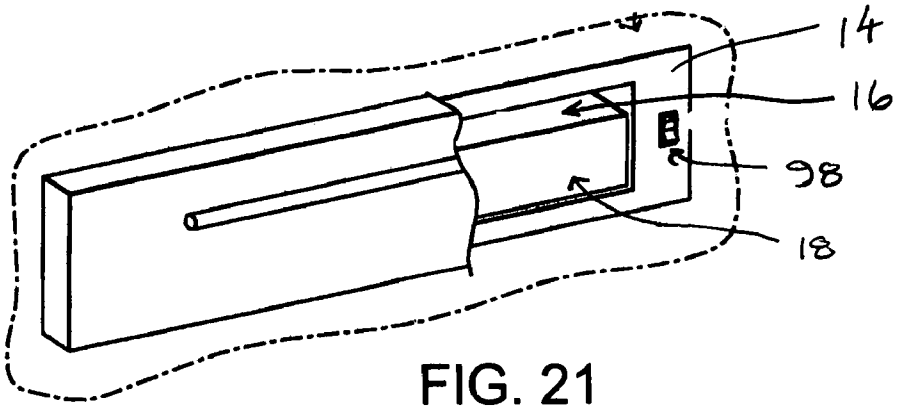
FIG. 21 is a partial perspective view of an exemplary embodiment of a face plate of a warming apparatus including an "on/off" type user interface.
Figure 19:
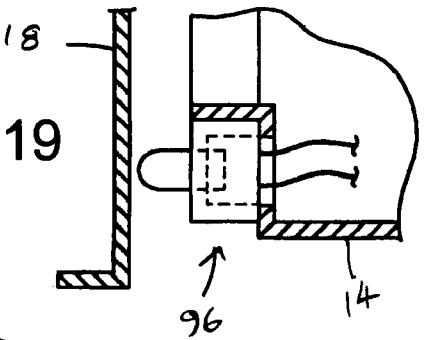
FIG. 19 is a detailed view of a mechanical door switch for operating the light fixtures of the warming apparatus illustrated in FIG. 18.
Figure 20:
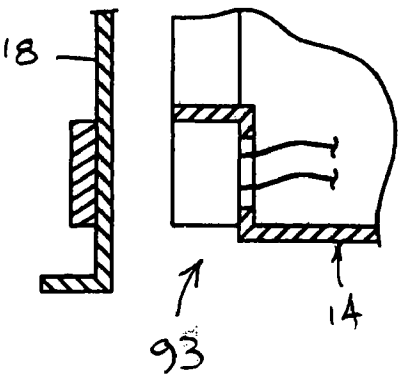
FIG. 20 is a detailed view of an electronic door switch activated with a magnet for operating the light fixtures of the warming apparatus illustrated in FIG. 18.

According to another embodiment, the chamber 16 of the warmer drawer/multi-use drawer 12 may be illuminated when the drawer is opened or when a switch is turned on (see FIGS. 18-21 for example). FIG. 19 illustrates one example of a door-actuated switch 96. FIG. 20 illustrates one example of an electronic sensor 93. FIG. 21 illustrates one example of a mechanical (e.g. rocker, etc.) switch 98. Because the extendable and retractable drawers may be positioned low to the ground and with a small opening, it is sometimes hard to see inside the chamber in certain applications. The use of a light 94 to illuminate the inside is of great help when trying to view the food or other objects without opening the drawer fully. The door or face panel of the cabinet can be provided with a viewing window, and a transparent shelf or pan can also be provided to increase visibility into the chamber.

According to another embodiment, the warmer drawer/multi-use drawer 12 may be configured for use through the electronic control system 40 to provide programmable set point(s), programmable set time(s) and programmable set operation(s) as well as multiples of set time(s), function(s), set points, operations or power on/off, by suitable interaction with the user interface. The ability to select multiple functions, operations and times gives the warmer drawer/multi-use drawer advantages over non-electronic controlled units. Timed on/off control can provide the ability to control the on/off time of the drawer. On/off time(s) can be infinitely set with the use of electronics. This programmability provides the advantage of being able to enter different functions or operations (e.g. more than one, etc.) into the electronic control system and have the warmer drawer/multi-use drawer control all desired functions, an advantage over mechanical or single function units. One can have one, two or more functions, operation(s), set point(s) with substantially limitless programming for control of these events. For example, one may start out with one temperature, at high temperature such as 200 degrees F. for one hour and then being able to reduce the temperature to 160 degrees F. for the remaining time. With a single function controlled warmer drawer the operator would typically have to manually reset the temperature. An electronically controlled warmer drawer/multi-use drawer (e.g. dual use drawer/triple use drawer) permits more user freedom.

A timer device, for example a clock, on the display device can also be provided, which can be changed to permit other programmable information to be displayed. Display illumination may also be selectable such that if the drawer is configured to expose the display, the display may serve as a night light or be adjusted for ease of viewing.

Figure 33:
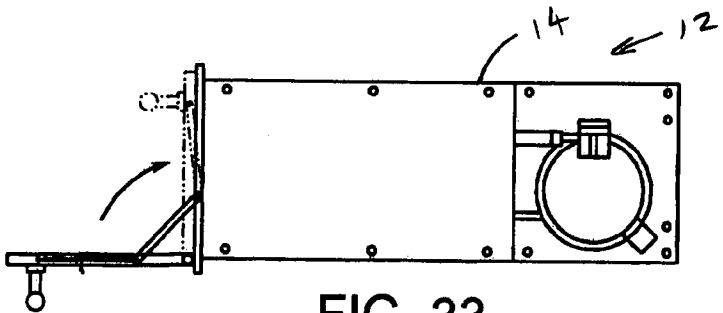
FIGS. 33 and 34 are alternative embodiments of a warming apparatus illustrating coupling and motion of a door (or panel) for accessing a chamber of the warming apparatus.
Figure 34:
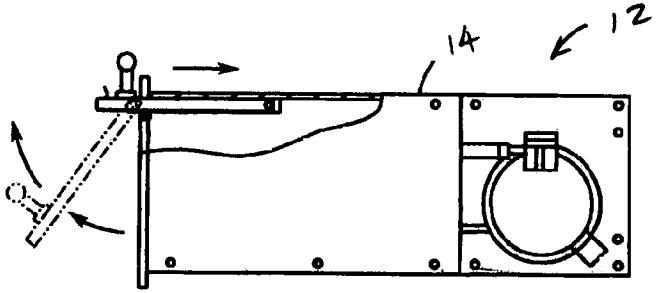

Another embodiment provides a warmer drawer/multi-use drawer 12 configured with a hinged door(s) (see FIGS. 33-34 for example). This permits the user to open the drawer by rotating or folding the door out of the way. The door(s) can be hinged rather than fixed, permitting the door(s) to remain in place and having the door(s) out of the way when accessing the contents of the warmer drawer/multi-use drawer. This also permits the user to open the door(s) to view inside the drawer without having to pull out all or some of the contents.

Figure 31:
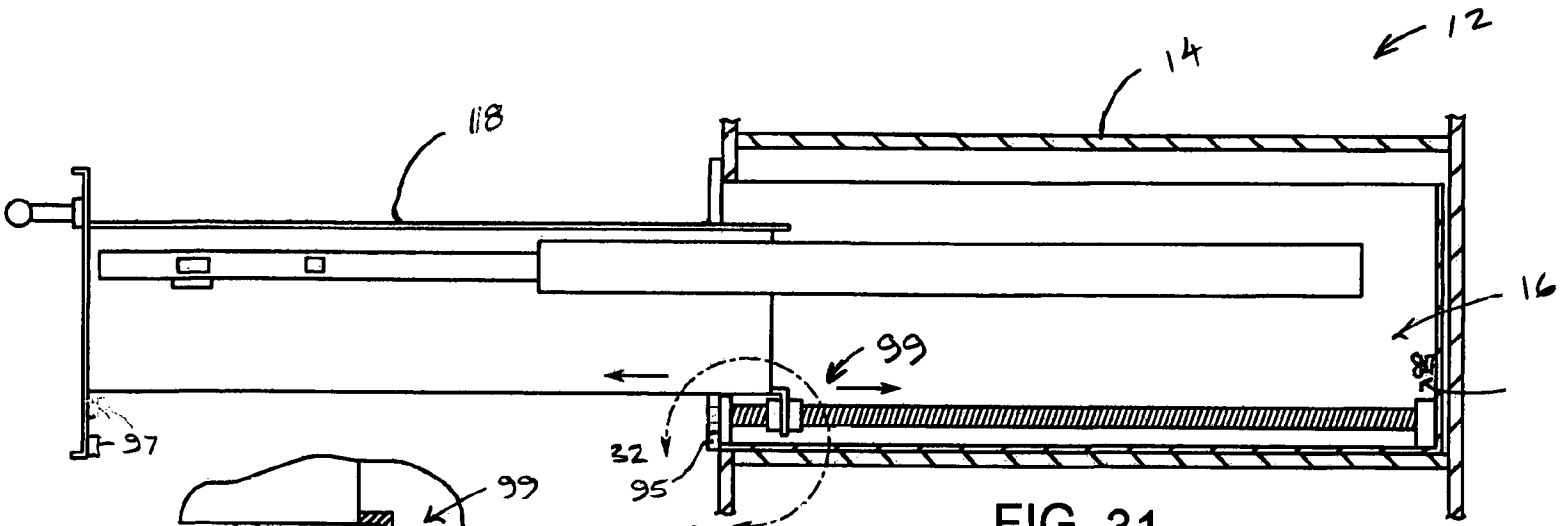
FIG. 31 is a side sectional view of an exemplary embodiment of a multi-use warming apparatus, including a powered drawer.
Figure 32:
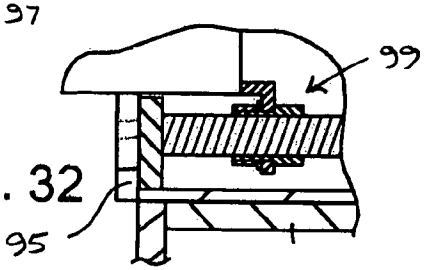
FIG. 32 is a detailed view of an exemplary embodiment of the warming apparatus with a powered drawer illustrated in FIG. 31.

Referring to FIGS. 31-32, a warmer drawer 12 is shown according to an exemplary embodiment having a powered extendable portion 18 (e.g. "servant drawer"—for convenient access for loading or removal of objects from the chamber) having the ability to open or close by the touch of a user or by some signal device so that a user can open or close the warmer drawer without having to pull or push on a handle or the like through the travel range of the extendable portion. Activation of the warmer drawer can be by touching the drawer door, breaking a beam, interrupting a signal, or having a feed back signal to a sensor/detect with no (or minimal) hand held control or contact with the warmer drawer or extendable portion. An activation system is provided to control operation of the extendable portion by interfacing with suitable sensors, the electronic control system 40 and a drive system 99. According to one embodiment, an activation system is shown as a hall sensor 95 and a magnet 97 used to determine the "stop points" and/or "start points" for movement of the extendable portion and initiate signals for opening and/or closing the extendable portion 18 (note that the sensor 95 is shown on the cabinet 14 and the sensor 95 is shown on the extendable portion 18; however, the sensor and magnet may reversed or provided on other suitable structures). For example, when opening of the extendable portion 18 is desired, the activation system receives an input and initiates a drive system 99 and the sensor 95 detects the initial movement of the magnet 97 away from the sensor 95, which may provide a signal to the display system 60 to indicate position of the extendable portion 18 and may also initiate operation of a drive system 99 (if movement of the extendable portion was manually initiated) to move the extendable portion 18 from a closed position to an open position (see FIG. 31). As the extendable portion 18 approaches the open position, another magnet (not shown) may approach the sensor 95, which then initiates a signal (e.g. a stop point) to terminate movement of the extendable portion. Movement of the extendable portion from the open position to the closed position may also operate in a reverse manner. For example, upon activation the drive system moves the extendable portion 18 toward the closed position, which is detected by the sensor as the (second) magnet moves away from the sensor 95 (and initiates operation of the drive system if manually activated) in a closing direction until sensor 95 detects the approach of magnet 97, such that the field of the magnet detected at the sensor indicates that the extendable portion has reached the desired position, such as the closed position (another stop point), which may correspond to any particular position (e.g. compression of a gasket between the extendable portion and the cabinet, etc.). Also, a change in resistance or other suitable indication can be used to determine the stop points. According to the illustrated embodiment in FIG. 31, a motor-driven drive screw system 99 is employed to move the extendable portion 18 open and closed (however, any suitable drive system such as a motor with a wire, cable, pulleys, etc. can be used). According to an alternative embodiment, a switch (or other suitable device such as light-beam sensors, resistive or inductive touch pads, etc.) can be used to operate the extendable portion and may be located on the unit or it can be remotely located for ease of operation and use, and can be operable to energize any suitable drive device for extending and retracting the extendable portion. According to other alternative embodiments, any suitable sensors and signals may be used to initiate opening or closing of the extendable portion, For example, the signal may be a sound, a voice, a noise signal (e.g. clapping or banging, etc.) interrupting a steady state condition; interrupting a beam of visible light or non-visible light; touching a surface which resistance increases or decreases providing a signal to a sensor for activation; force activation by pushing on the door front; and by a remote control signal such as a hand held control using a radio frequency or light beam, cooperating with suitable sensors. These and other methods can be used to activate the drive system for opening and closing the extendable portion 18 of the warmer drawer 12. By providing an activation system cooperating with a drive system responsive to selected stop points and start points, a user has the ability to actuate the extendable portion (e.g. by touch, interruption of a signal, switch operation, etc.), to which the warmer drawer 12 responds by opening and providing access to the extendable portion 18 and chamber 16 without having to manually pull or push the extendable portion throughout its travel range to access the contents. According to another embodiment, the activation system may detect an increase in resistance as the motor of the drive system 99 approaches (or reaches) the stop point and provide an output signal to stop the motor (or reverse the direction of the motor, or other desirable control action). According to a further embodiment, a stepper motor may be provided so that the number of turns can be counted by the activation system to determine the stop point and provide an appropriate output signal to control operation of the extendable portion.

According to another embodiment, the warmer drawer 12 may also be configured to cool (e.g. refrigerate) objects placed in the drawer. For example, a heat pump system may be substituted for the fan and heater (previously described). By further way of example, a magnetic refrigeration device, or may be a thermoelectric heating/cooling module (e.g. a Peltier-type device or module, etc.).

According to any exemplary embodiment, a warming apparatus such as a warmer drawer for use in stationary or mobile applications in any desirable environment is provided with an electronic controller that interfaces with a heating system (having one or more heating elements within the chamber or remote from the chamber, and that receive electrical power in a continuously variable and regulated manner to provide precise temperature control within a chamber), a ventilation system (including an air flow device such as a variable speed fan/motor, and a variably positionable louver/vent device driven by an actuator for air, heat and/or humidity control), a user interface (locally-controlled or remote-controlled) to permit a user to control the operation of the warmer drawer in a simple and convenient manner, and a display device arranged to provide information to a user in the form of alpha-numeric text messages (stationary or scrolling) and/or graphic images. The warmer drawer may be converted to a multi-use drawer by providing suitable elements within the chamber, (e.g. for cooling, or for other purposes such as baking, broiling, boiling, steaming, roasting, etc.). The warmer drawer may be installed in any convenient arrangement such as on a mobile pedestal, or supported by a cabinet, such as under a counter, or with a built-in oven as more fully described in a publication entitled Warming Drawer Installation Instructions, 803150/983-0152-000 REV C, 11/04, commercially available from Wolf Appliance Company LLC of Madison, Wis. The warmer drawer may also feature stainless steel construction, ball bearing drawer glides and accessories such as optional drawer fronts and racks for staking objects in the chamber, and may have an automatic shut-off mode, or a preset programming mode, and variable moisture selection operating features as more fully described in a publication entitled Warming Drawer Use & Care Information, 803149/983-0145-000 REV C, 1/04, commercially available from Wolf Appliance Company LLC of Madison, Wis.

The construction and arrangement of the elements of the warning apparatus as shown in the illustrated and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, circuit form, type and interaction, use of sensors, etc.) without materially departing from the novel teachings and advantages of the subject matter recited herein. For example, elements shown as integrally formed may be constructed of multiple parts or elements, the position of elements may be reversed or otherwise varied, and the nature or number of discrete elements or positions may be altered or varied. Other substitutions, modifications, changes and omissions may be made in the design, operating conditions and arrangement of the preferred and other exemplary embodiments without departing from the scope of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A warmer drawer, comprising:

an enclosure defining a chamber and having an opening;

a movable portion configured to be reciprocally moved within the chamber;

a heating element configured to provide heat to the chamber;

a user interface configured to receive input from a user for controlling operation of the warmer drawer;

an IR scanning sensor to provide a signal representative of a temperature of an object in the chamber;

and an electronic control system interfacing with the heating element, and the user interface and the sensor and operable to control a supply of electrical power in a continuous and regulated manner to the heating element during operation of the warmer drawer;

wherein the IR scanning sensor collects energy radiated from the object and generates an electrical signal, and wherein the electronic control system receives the signal from the IR scanning sensor and adjusts the heat from the heating element, and wherein the electronic control system receives the signal from the IR scanning sensor and compensates for the ambient temperature and emissivity within a fraction of a second after a user places the object into the chamber.

2. The warmer drawer of claim 1 wherein the electronic control system comprises a positive temperature coefficient controller.

3. The warmer drawer of claim 2 wherein the user interface comprises a touch pad device having a plurality of input elements.

4. The warmer drawer of claim 3 wherein the touch pad device comprises an operating technology selected from the group consisting of piezo electric, capacitance, inductive, resistance, infrared, and high frequency.

5. The warmer drawer of claim 3 wherein the touch pad device comprises a membrane switch.

6. The warmer drawer of claim 3 wherein the user interface is operable remotely from the enclosure to permit a user to control operation of the warmer drawer from a remote location.

7. The warmer drawer of claim 4 further comprising a second sensor selected from the group consisting of a humidity sensor and a temperature sensing device.

8. The warmer drawer of claim 7 wherein the second sensor is selected from the group consisting of a thermostat, a thermal protector, a thermal cutoff, a thermal switch, a thermocouple, a PCB thermostat, a time delay relay, a bulb and capillary device, a cold control, a bimetallic device, a pressure switch, resistance temperature detector, a snap action switch, and a thermistor.

9. The warmer drawer of claim 8 further comprising a display device configured to provide information to a user.

10. The warmer drawer of claim 9 wherein the display device is configured to display alpha-numeric text in at least one of a stationary manner and a scrolling manner.

11. The warmer drawer of claim 9 wherein the display device is configured to display graphic images for perception by a user.

12. The warmer drawer of claim 11 wherein the display device comprises a display panel having technology selected from the group consisting of light emitting diodes, liquid crystal display, plasma, dot matrix, and vacuum fluorescent display.

13. The warmer drawer of claim 12 wherein the display device is integrated with the user interface.

14. The warmer drawer of claim 1 further comprising a ventilation system operably interfacing with the electronic control system.

15. The warmer drawer of claim 14 wherein the ventilation system comprises a remote damper and a fan configured to circulate air within the chamber.

16. The warmer drawer of claim 15 wherein the fan is coupled to the enclosure.

17. The warmer drawer of claim 16 wherein the enclosure is mountable within another appliance selected from the group consisting of a range, a mini-oven, a toaster oven, a steam drawer, a baking drawer, a boiling oven, a broiling oven.

18. The warmer drawer of claim 15 wherein the heating element is integrated with the fan.

19. The warmer drawer of claim 14 wherein the ventilation system comprises a plurality of apertures in the enclosure and a variably positionable damper operable to regulate a flow of air through the apertures.

20. The warmer drawer of claim 19 further comprising an actuator operable to position the damper in response to a signal from the electronic control system.

21. The wanner drawer of claim 20 wherein the actuator comprises at least one of a solenoid drive device, a screw drive device, a gear drive device, a motor driven device, a cylinder driven device, a biasing member, a bi-metal device, an electromagnetic device and an electronically actuated device.

22. The warmer drawer of claim 15 wherein the fan is located remotely from the chamber and communicates with the chamber via a duct.

23. The warmer drawer of claim 22 wherein the heating element is located remotely from the chamber and communicates with the chamber via a duct.

24. The warmer drawer of claim 23 wherein an air temperature contained within the chamber is maintained at a predetermined temperature.

25. The warmer drawer of claim 23 wherein the touch pad device comprises an operating technology selected from the group consisting of a padless soft touch technology, a padless touch digital encoder, a magnetic switch, a field effect device, a charge transfer device, a hall effect device, a transistor, a micro encoder, an induction device, a capacitance device, and an inductive device.

26. A warming apparatus, comprising:

an enclosure defining a chamber configured to receive one or more objects therein;

a heating device communicating with the chamber;

a detection system having at least one active IR scanning sensor operable to detect a temperature within the chamber;

a user interface configured for interaction with a user and operable to establish a preferred temperature for the chamber;

an electronic control system configured to receive a signal from the at least one sensor and the user interface to control the operation of the heating device to actively adjust and maintain the preferred temperature within the chamber; and wherein the IR scanning sensor collects a small amount of energy radiated from the object and generates an electrical signal that is amplified by a precision amplifier, and wherein the electronic control system converts the amplified electrical signal into voltage output by an Analog-to-Digital Converter to compensate for the ambient temperature and emissivity all within a fraction of a second after a user places the object into the chamber.

27. The warming apparatus of claim 26 wherein the heating device comprises a heat pump operable to increase and decrease a temperature within the chamber.

28. The warming apparatus of claim 26 wherein the heating device comprises a thermoelectric module operable to warm or cool the objects in the chamber.

29. The warming apparatus of claim 26 wherein the heating device is operable to conduct at least one of the functions of baking, broiling, roasting, steaming and boiling within the chamber.

30. The warming apparatus of claim 26 further comprising a display device having a screen portion operable to convey information to a user related to operation of the warmer drawer.

31. The warming apparatus of claim 30 wherein the information includes at least one of operating information, temperature information, functions, messages, time and diagnostics.

32. The warming apparatus of claim 31 further comprising an illumination source within the chamber.

33. The warming apparatus of claim 32 further comprising a mobile structure coupled to the enclosure.

34. The warming apparatus of claim 26 wherein the electronic control system comprises a microprocessor operable to interface with one or more of the heating device, the detection system, the user interface and a ventilation system and a display device.

35. The warming apparatus of claim 26 wherein the heating device comprises a heating element configured to receive a supply of electrical current regulated by the electronic control system within a range between a minimum current and a maximum current during operation of the warming apparatus.

36. The warming apparatus of claim 32 wherein the user interface is operable for wireless remote control operation of the warming apparatus.

37. The warming apparatus of claim 36 wherein the wireless remote control operation is accomplished by at least one of a sound activated signal, a radio frequency signal, an electromagnetic signal, and a computer control system.

38. The warming apparatus of claim 26 wherein the enclosure is configured to be removably received for independent operation within any one or more of a fixed structure, a mobile structure and an appliance.

39. The warming apparatus of claim 26 wherein the enclosure is configured to be combined with other enclosures in at least one of a horizontal arrangement and a vertical arrangement.

40. The warming apparatus of claim 37 wherein the enclosure further comprises at least one of a selectively movable door, a lid, and a cover configured to provide access to the chamber by a user.

41. The warming apparatus of claim 26 wherein the IR scanning sensor detects and transmits a signal representative of a temperature of an object within the chamber.

42. The warming apparatus of claim 26 wherein the heating device comprises a thermoelectric module operable to warm or cool air in the chamber.

43. an electronically controlled multi-use warming appliance, comprising:

an enclosure defining a chamber configured to receive one or more objects therein;

a first heating device communicating with the chamber and a second heating device communicating with the chamber;

a detection system having a temperature sensing device communicating with the chamber;

a user interface configured for interaction with a user and operable to establish a desired temperature within the chamber;

an electronic control system configured to receive a signal from the temperature sensing device and the user interface to control operation of the first heating device and the second heating device;

wherein the electronic control system includes at least one of a current regulator and voltage regulators connected to the heating element, and at least one shielding means to shield an integrated circuit, a PC board, a processor, and other electronics; and wherein the detection system detects the presence and temperature of an object in the chamber within a fraction of a second after a user places the object into the chamber and signals the control system to adjust the temperature via the first and second heating devices.

44. The electronically controlled multi-use warming appliance of claim 43 wherein the first heating device is selected from the group consisting of a cross flow blower with an integrated heating element, an axial fan and heater unit, a wire heating element, a sheathed heating element, a heat plate, a thermal ceramic heater, a flexible heater, a thin film heating element, a light source, an inductive heating element, a heat pump, an infrared heater, and electromagnetic heating device, a radio frequency heating device, a sonic heating device, a heat exchanger, a gas fuel product, and a solid fuel product.

45. The electronically controlled multi-use warming appliance of claim 44 wherein the first heating device is configured for at least one of cooking, toasting, baking, broiling and boiling.

46. The electronically controlled multi-use warming appliance of claim 45 wherein the second heating device comprises a microwave device.

47. The electronically controlled multi-use warming appliance of claim 43 wherein the enclosure is at least partially surrounded by a cabinet and combined with at least one other appliance.

48. The electronically controlled multi-use warming appliance of claim 47 wherein the at least one other appliance comprises one or more of a range, a mini-oven, a toaster oven, a steam drawer, a baking drawer, a boiling oven, a broiling oven and a microwave oven.

49. The warming appliance of claim 43, further comprising a ventilation system operably connected to at least one heating element via a duct, and wherein the ventilation system includes a variable speed fan for circulating outside and inside air.

50. An electronically controlled multi-use warming appliance, comprising:

an enclosure defining a chamber configured to receive one or more objects therein;

a first heating device communicating with the chamber and a second heating device communicating with the chamber;

a detection system having a temperature sensing device communicating with the chamber;

a user interface configured for interaction with a user and operable to establish a desired temperature within the chamber;

an electronic control system that receives a signal from the temperature sensing device and the user interface and that controls operation of the first heating device and the second heating device;

wherein the detection system detects the presence and temperature of an object in the chamber within a fraction of a second after a user places the object into the chamber and signals the control system to adjust the temperature via the first and second heating devices.

* * * * *